US010027072B1

(12) United States Patent
Shaeffer et al.

(10) Patent No.: US 10,027,072 B1
(45) Date of Patent: Jul. 17, 2018

(54) PLUG ASSEMBLIES

(71) Applicant: R&S Shaeffer Properties LLC, Ector, TX (US)

(72) Inventors: Ricky David Shaeffer, Bonham, TX (US); Jared Tanner Shaeffer, Bonham, TX (US)

(73) Assignee: R&S Schaeffer Properties LLC, Ector, TX (US)

( * ) Notice: Subject to any disclaimer, the term of this patent is extended or adjusted under 35 U.S.C. 154(b) by 0 days.

(21) Appl. No.: 15/408,860

(22) Filed: Jan. 18, 2017

(51) Int. Cl.

| | |
|---|---|
| ***H01R 33/00*** | (2006.01) |
| ***H01R 24/38*** | (2011.01) |
| ***H01R 24/28*** | (2011.01) |
| ***H01R 24/76*** | (2011.01) |
| *H01R 107/00* | (2006.01) |

(52) U.S. Cl.
CPC ..... *H01R 24/38* (2013.01); *H01R 24/28* (2013.01); *H01R 24/76* (2013.01); *H01R 2107/00* (2013.01); *H01R 2201/26* (2013.01)

(58) Field of Classification Search
CPC ..... H01R 2201/26; H01R 2107/00; H01R 24/28; H01R 24/76; H01R 24/38
USPC ..... 439/43, 660, 682, 924.1, 35
See application file for complete search history.

(56) References Cited

U.S. PATENT DOCUMENTS

| | | | | |
|---|---|---|---|---|
| 3,915,476 A | | 10/1975 | Burkle | |
| 3,953,099 A | | 4/1976 | Wilson | |
| 4,113,333 A | | 9/1978 | Horowitz | |
| 4,245,875 A | * | 1/1981 | Shaffer | H01R 27/00 439/144 |
| 4,770,644 A | * | 9/1988 | Feder | B60D 1/64 439/166 |
| 4,842,532 A | | 6/1989 | Krause | |
| 4,846,697 A | | 7/1989 | Rodgers | |
| 4,983,127 A | | 1/1991 | Kawai | |
| 5,302,141 A | | 4/1994 | O'Reilly | |
| 5,354,204 A | * | 10/1994 | Hughes | B60D 1/64 439/35 |
| 5,443,389 A | | 8/1995 | Hughes | |
| 5,626,479 A | * | 5/1997 | Hughes | B60D 1/62 439/35 |
| 5,800,188 A | | 9/1998 | Barber | |
| 5,899,766 A | | 5/1999 | DeFeo | |

(Continued)

*Primary Examiner* — Abdullah Riyami
*Assistant Examiner* — Nelson R Burgos-Guntin
(74) *Attorney, Agent, or Firm* — Maschoff Brennan

(57) ABSTRACT

A plug assembly for a vehicle-trailer wiring connector assembly includes a plug housing, six connector cavities, and a first and second electrical connectors. The plug housing is positionable in a receptacle assembly. The six connector cavities are defined in and radially disposed around a connecting face of the plug housing in compliance with the Society of Automotive Engineers J2863 standard. The first electrical connector is positioned with respect to a first connector cavity of the cavities. A first contact surface of the first electrical connector is contactable within the first connector cavity. The second electrical connector is positioned with respect to the plug housing. A second contact surface of the second electrical connector is substantially aligned with an outer surface of the plug housing and externally contactable. The second electrical connector is positioned relative to the first electrical connector such that the second electrical connector is electrically insulated therefrom.

23 Claims, 14 Drawing Sheets

(56) References Cited

U.S. PATENT DOCUMENTS 5,993,262 A * 11/1999 Kowdynski ..... H01R 31/06 439/35
6,007,346 A 12/1999 Gutierrez
6,027,377 A * 2/2000 Wang ..... H01R 24/60 439/35
6,048,224 A 4/2000 Kay
6,054,779 A 4/2000 Zubko
6,413,101 B2 * 7/2002 Divoll ..... H01R 31/065 439/35
6,447,302 B1 * 9/2002 Davis ..... H01R 29/00 439/34
6,450,833 B1 * 9/2002 Brown, Jr. ..... B60D 1/64 439/518
6,533,465 B1 3/2003 Lesesky
6,558,167 B2 5/2003 Harmon
6,623,277 B1 9/2003 Zhu
6,695,621 B1 2/2004 Wang
6,749,438 B1 6/2004 Scheller
6,786,747 B1 9/2004 Kamath
6,814,581 B2 11/2004 Matsuo
7,118,379 B1 * 10/2006 Wang ..... H01R 13/6641 439/35
7,291,017 B1 11/2007 Fain
7,374,460 B1 5/2008 Hariharesan
7,467,977 B1 12/2008 Yi
7,534,108 B1 5/2009 Wang
7,575,450 B2 * 8/2009 Williams ..... H01R 13/5219 439/144
7,575,462 B2 8/2009 Macey
7,578,708 B2 8/2009 Hachadorian
7,594,816 B1 9/2009 Wang
D602,433 S * 10/2009 Katou ..... D13/120
7,597,583 B2 10/2009 Zhuang
7,601,007 B1 * 10/2009 Pogue ..... B60D 1/62 439/35
7,651,344 B2 1/2010 Wu
7,744,383 B2 6/2010 Da Silva
7,850,191 B1 * 12/2010 Kaminski ..... B60D 1/64 280/420
7,914,344 B2 3/2011 Tin
7,927,108 B2 4/2011 Gong
8,079,878 B2 12/2011 Huang
8,215,656 B1 * 7/2012 Kaminski ..... B60D 1/64 280/420
8,414,339 B1 * 4/2013 Glick ..... H01R 13/187 439/357
8,435,078 B2 5/2013 Hsueh
8,465,300 B2 6/2013 Lin
8,545,276 B2 10/2013 Farahani
8,845,155 B2 * 9/2014 Rotenberg ..... H01R 13/70 307/10.8
8,932,065 B2 1/2015 Gerling
9,093,788 B2 7/2015 Lamb
9,444,207 B1 9/2016 Smith
9,463,702 B2 * 10/2016 Fukushima ..... H01R 13/506
9,496,639 B2 11/2016 Harmon
9,559,475 B1 * 1/2017 Shaeffer ..... H01R 31/06
9,590,342 B1 * 3/2017 Shaeffer ..... B60D 1/64
2004/0053525 A1 * 3/2004 Matsuo ..... H01R 13/5202 439/142
2009/0215315 A1 8/2009 Cheng
2009/0253295 A1 10/2009 Kameyama
2009/0311881 A1 * 12/2009 Dilgard ..... H01R 31/02 439/35
2010/0105226 A1 4/2010 Gong
2011/0318951 A1 * 12/2011 Armacost ..... H01R 13/745 439/345
2012/0156896 A1 * 6/2012 Corless ..... H01R 13/447 439/35
2012/0171900 A1 * 7/2012 Sebald ..... B60L 11/1818 439/626
2012/0202377 A1 * 8/2012 Puluc ..... H01R 13/5219 439/559
2012/0231644 A1 9/2012 Kinoshita
2012/0315801 A1 * 12/2012 Kwasny ..... B60L 11/1818 439/695
2013/0109237 A1 * 5/2013 Glick ..... H01R 13/187 439/625
2014/0017910 A1 * 1/2014 Gerling ..... B60D 1/64 439/35
2014/0038463 A1 * 2/2014 Natter ..... B60L 3/0069 439/620.34
2014/0273577 A1 * 9/2014 Puluc ..... H01R 13/62 439/271
2014/0295683 A1 * 10/2014 Gette ..... H01R 13/453 439/137
2014/0295684 A1 * 10/2014 Gette ..... H01R 13/447 439/137
2015/0084504 A1 * 3/2015 Rokenbrodt ..... B60D 1/64 315/77
2015/0222049 A1 * 8/2015 Armacost ..... B60D 1/64 439/312
2015/0357767 A1 * 12/2015 Kageta ..... H04N 7/183 439/620.22
2016/0104967 A1 * 4/2016 Schmidt ..... H01R 13/5202 439/587
2017/0077634 A1 * 3/2017 Markefka ..... H01R 13/05

* cited by examiner

PLUG ASSEMBLIES

FIELD

The embodiments described in the present disclosure are related to plug assemblies.

BACKGROUND

When towing and otherwise using a trailer, electrical signals may be communicated between a tow vehicle and the trailer via a vehicle-trailer wiring connector assembly (hereinafter, connector assembly). Generally, the connector assembly includes a receptacle assembly that is physically coupled to the tow vehicle and a plug assembly that is physically coupled to the trailer. The receptacle assembly is wired to one or more systems of the tow vehicle and retains electrical connectors. Similarly, the plug assembly is wired to one or more systems of the trailer and retains corresponding electrical connectors. The plug assembly may be positioned within the receptacle assembly. When the plug assembly is positioned in the receptacle assembly, the electrical connectors retained in the receptacle assembly are electrically connected to the corresponding electrical connectors of the plug assembly. Accordingly, when the plug assembly is positioned in the receptacle assembly, electrical signals that originate in the tow vehicle may be communicated to the trailer via the electrical connection of the connector assembly.

The connector assembly and components thereof may be constructed according to one or more connector assembly standards. The connector assembly standards may include dimensions of the connector assembly and components thereof as well as a wiring guide. The connector assembly standards help ensure that the plug assembly fits into and is retained by the receptacle assembly and help ensure that each of the electrical connectors retained in the receptacle assembly is electrically connected with the corresponding electrical connector retained in the plug assembly.

One connector assembly standard provides dimensions and a wiring guide for seven-way connector assemblies. Connector assemblies constructed according to the seven-way connector assembly standard include a central electrical connector and six electrical connectors that surround the central electrical connector. Connector assemblies constructed according to the seven-way connector assembly standard include an electrical connector for a ground, a brake controller, a left turn and left stop light, a right turn and right stop light, reverse (or back-up) lights, a 12 volt auxiliary power, and tail and running lights. There is a seven-way connector assembly standard for round electrical connectors and for blade-style electrical connectors. In general, the round electrical connectors are used in heavy-duty applications, while blade-style electrical connectors are used in recreational vehicles, cargo trailers, fifth wheels, campers, and other types of trailers. An example standard for the round electrical connectors is the Society of Automotive Engineers (SAE) J560b standard, which is incorporated in the present disclosure by reference in its entirety. An example standard for the blade-style electrical connectors may include the SAE J2863 standard, which is incorporated in the present disclosure by reference in its entirety.

The subject matter claimed in the present disclosure is not limited to embodiments that solve any disadvantages or that operate only in environments such as those described above. Rather, this background is only provided to illustrate one example technology area where some embodiments described herein may be practiced.

SUMMARY

An aspect of the present disclosure may include a plug assembly for a vehicle-trailer wiring connector assembly.

The plug assembly may include a plug housing, six connector cavities, a first electrical connector, and a second electrical connector. The plug housing may be configured to be positioned in a receptacle assembly. The six connector cavities may be defined in the plug housing and are radially disposed around a connecting face of the plug housing in an arrangement in compliance with the Society of Automotive Engineers ("SAE") J2863 standard. The first electrical connector may be disposed and positioned with respect to a first connector cavity of the six connector cavities such that a first contact surface of the first electrical connector is contactable within the first connector cavity. The second electrical connector may be disposed and positioned with respect to the plug housing such that a second contact surface of the second electrical connector is substantially aligned with an outer surface of the plug housing and externally contactable and such that the second electrical connector is displaced relative to the first electrical connector in a manner in which the second electrical connector is electrically insulated from the first electrical connector.

The object and advantages of the embodiments will be realized and achieved at least by the elements, features, and combinations particularly pointed out in the claims.

It is to be understood that both the foregoing general description and the following detailed description are exemplary and explanatory and are not restrictive of the invention, as claimed. description are exemplary and explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF SOME EXAMPLE EMBODIMENTS

Figure 1A:
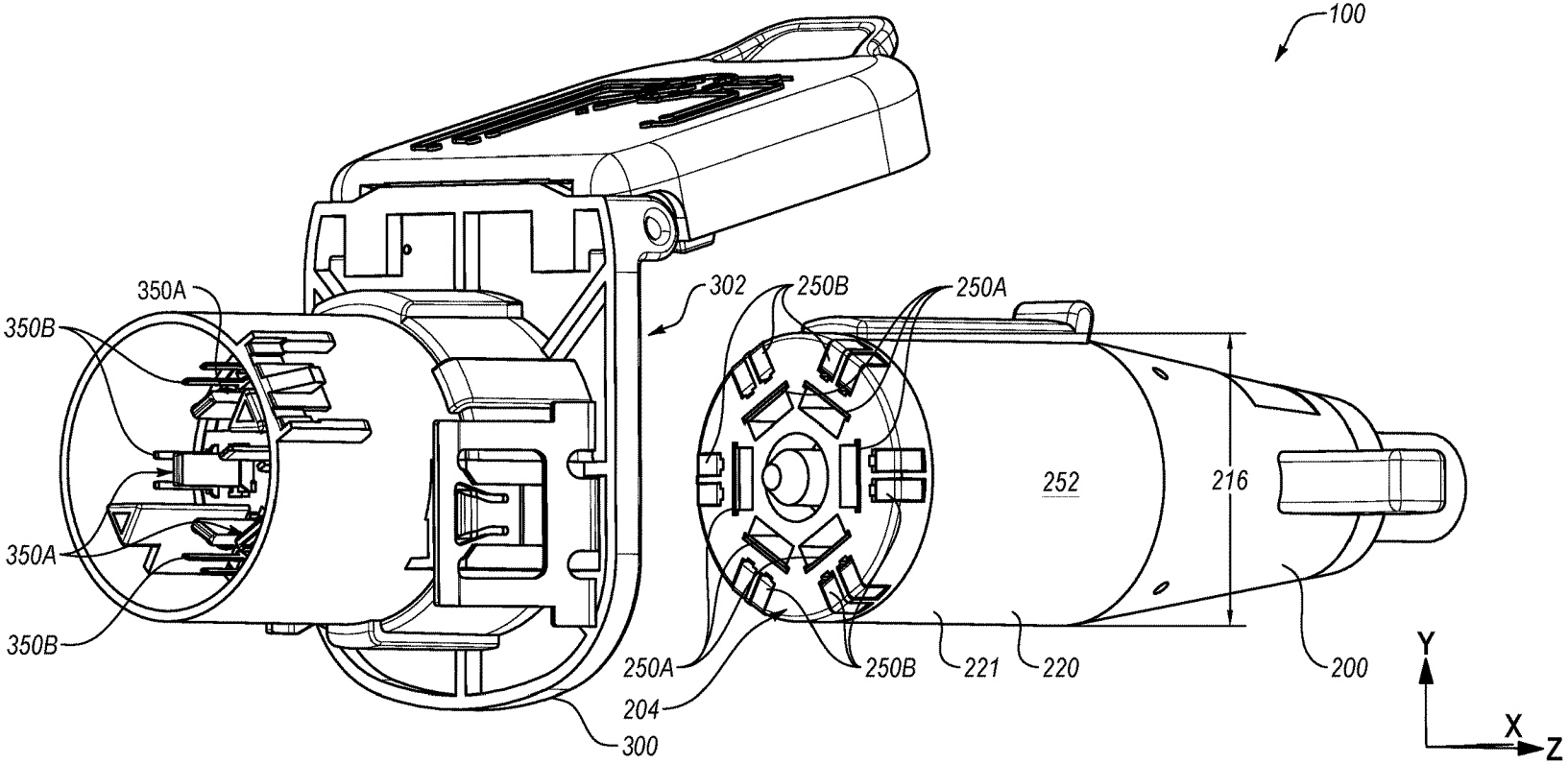
FIG. 1A illustrates an example vehicle-trailer wiring connector assembly (connector assembly)

Vehicle-trailer wiring connector assemblies (hereinafter, connector assemblies) may include a receptacle assembly that may be physically coupled to a tow vehicle and a plug assembly that may be physically coupled to a trailer. When towing and otherwise using the trailer, electrical signals may be communicated between the tow vehicle and the trailer via the connector assembly. For example, the receptacle assembly may be configured to be wired to one or more systems of the tow vehicle and may include electrical connectors that may be configured to be electrically connected to wires that may correspond to the one or more systems in that the wires may each be configured to carry electrical signals that may be used by one of the systems. Similarly, the plug assembly may be configured to be wired to one or more systems of the trailer and may include electrical connectors that may be configured to be electrically connected to wires that may also correspond to the one or more systems of the trailer. The plug assembly may be configured to be positioned within the receptacle assembly such that, when the plug assembly is positioned within the receptacle assembly, each of the electrical connectors included in the receptacle assembly are electrically connected to one of the electrical connectors of the plug assembly. Accordingly, when the plug assembly is positioned in the receptacle assembly, electrical signals may be communicated between systems of the tow vehicle and corresponding systems of the trailer via the electrical connections of the connector assembly. In the present disclosure, the term "electrical signals" may refer to any direct current (DC) or alternating current (AC) voltage or current, which may include voltages or currents supplied from a positive terminal of a power system (e.g., a positive terminal of a battery or a supply node of an alternator) and return currents that pass through a "neutral" or "ground" wire connected to a negative terminal of the power system (e.g., a negative terminal of the battery) or to a ground (e.g., the body of the vehicle) and associated voltages.

As tow vehicles and trailers become more complex, a number of systems that may communicate between the trailers and the tow vehicles may increase. For example, trailers may include a back-up camera, sonar systems, tire pressure monitoring systems, weight monitoring systems, alarm systems, etc., which drivers of the tow vehicles may wish to actuate or use.

Such advancements in trailers and tow vehicles may result in an increase in a number of electrical connectors in the plug assembly and the receptacle assembly. However, a tow vehicle with a receptacle assembly that includes an increased number of electrical connectors may not be readily compatible with trailers with plug assemblies that include fewer electrical connectors. Similarly, a trailer with a plug assembly that includes an increased number of electrical connectors may not be readily compatible with tow vehicles with receptacle assemblies that include fewer electrical connectors. The incompatibility of tow vehicles and trailers may be problematic for users. For example, a user may purchase a newer tow vehicle and a newer trailer between which thirteen or another suitable number of electrical signals are communicated. The user may additionally own an older trailer in which seven electrical signals may be communicated between the tow vehicle and the older trailer. In existing systems, the user may be forced to use multiple receptacle assemblies to use the newer trailer and the older trailer with the newer tow vehicle or the older tow vehicle.

Accordingly, some embodiments described in the present disclosure may include a connector assembly that is configured to enable an interface of plug assemblies and receptacle assemblies with different numbers of electrical connectors in multiple configurations. For example, in an example embodiment, the connector assembly may include a receptacle assembly. The receptacle assembly may include a receptacle housing, a housing opening, a first receptacle connector, and a second receptacle connector. The receptacle housing may include a first cavity. The first cavity may extend from a first end of the receptacle housing to a central structure of the receptacle housing. The housing opening may be defined at the first end. At least a portion of the first cavity and at least a portion of the housing opening may be sized and shaped to enable insertion of a plug assembly. The first receptacle connector may include a first portion that extends from the central structure into the first cavity. The first receptacle connector is sized such that the first receptacle connector is configured to be inserted into one of the six connector cavities of the plug assembly. The second receptacle connector may include a second portion that is disposed and positioned at least partially on an interior surface of the first cavity and contactable within the first cavity. The second receptacle connector is electrically insulated from the first receptacle connector.

In another example embodiment, the connector assembly may include a plug assembly. The plug housing may be configured to be positioned in a receptacle assembly. The plug assembly may include a plug housing, six connector cavities, a first electrical connector, and a second electrical connector. The six connector cavities may be defined in the plug housing and are radially disposed around a connecting face of the plug housing in an arrangement in compliance with the SAE J2863 standard. The first electrical connector may be disposed and positioned with respect to a first connector cavity of the six connector cavities such that a first contact surface of the first electrical connector is contactable within the first connector cavity. The second electrical connector may be disposed and positioned with respect to the plug housing such that a second contact surface of the second electrical connector is substantially aligned with an outer surface of the plug housing and externally contactable and such that the second electrical connector is displaced relative to the first electrical connector in a manner in which the second electrical connector is electrically insulated from the first electrical connector. These and other embodiments are described with reference to the appended figures in which items labelled with the same item number indicate similar structures unless otherwise described.

In the present disclosure, reference to an assembly being "configured according to the SAE J2863 standard" or "in compliance with the SAE J2863 standard" may refer to the assembly being sized, shaped, constructed, wired, etc., or having one or more components that are sized, oriented, shaped, placed, constructed, wired, etc., such that the assembly provides a particular function according to the SAE J2863 standard. For example, reference to a plug assembly being configured according to the SAE J2863 standard may indicate that the plug assembly has electrical connectors (e.g., "plug connectors") that are sized, shaped, oriented, placed, etc., such that they may be electrically connected with systems of a trailer included in the SAE J2863 standard and such that the plug connectors may interface with electrical connectors of a receptacle assembly (e.g., "receptacle connectors") that are also sized, shaped, oriented, placed, etc., according to the SAE J2863 standard.

Additionally, reference to a component of an assembly being "configured according to the SAE J2863 standard" or "in compliance with the SAE J2863 standard" may refer to the component being sized, oriented, shaped, placed, constructed, wired, etc., or having one or more sub-components that are sized, oriented, shaped, placed, constructed, wired, etc., such that the component provides a particular function according to the SAE J2863 standard. For example, reference to a receptacle connector being configured according to the SAE J2863 standard may indicate that the receptacle connector is sized, shaped, oriented, placed, etc., such that it may be inserted in a connector cavity of a plug assembly and contact a plug connector disposed in the connector cavity where the connector cavity and the plug connector are sized, shaped, oriented, placed, etc., according to the SAE J2863 standard. Similarly, reference to a connector cavity being configured according to the SAE J2863 standard may indicate that the connector cavity is sized, shaped, oriented, placed, etc., such that a corresponding receptacle connector may be inserted in the connector cavity. Further, reference to plug assemblies or receptacle assemblies being configured according to the SAE J2863 standard may indicate that each of the plug connectors or receptacle connectors may be assigned to correspond to a particular system depending on their placement and designation in the SAE J2863 standard.

In addition, reference to a particular component of a particular assembly (e.g., reference to a plug connector of a plug assembly) or reference to a particular sub-component of a component being configured according to the SAE J2863 standard does not require that the entire assembly or component is configured exactly according to the SAE J2863 standard. For example, a particular plug assembly may be described as including a plug connector configured according to the SAE J2863 standard but may also include one or more additional plug connectors that may not be part of the SAE J2863 standard.

Similarly, reference to a component (e.g., an electrical connector) corresponding to the SAE J2863 standard may indicate that the component provides a particular function that may be outlined by the SAE J2863 standard. For example, the SAE J2863 standard includes seven different electrical connectors for each plug and receptacle assembly where the seven electrical connectors are designated to provide electrical connections associated with the following systems or functions: (1) left turn/stop lights; (2) "–" or ground; (3) electric brakes; (4) right turn/stop lights; (5) "+" or power supply; (6) running lights; and (7) reverse lights. Therefore, reference to an electrical connector or electrical connectors corresponding to the SAE J2863 standard may indicate that the electrical connector or electrical connectors provide electrical connections that correspond to one of the seven systems or functions detailed in the SAE J2863 standard.

Additionally, reference to a component (e.g., an electrical connector) being outside of or in addition to the SAE J2863 standard may indicate that the component provides a function that may not be included in the SAE J2863 standard. For example, an electrical connector that provides electrical connections associated with systems or functions other than the seven listed above for the SAE J2863 standard may be referred to as being outside of or in addition to the SAE J2863 standard. Similarly, reference to a component corresponding to a system that is outside of or in addition to the SAE J2863 standard may indicate that the component provides a function for such systems that are not included in the SAE J2863 standard or that may provide a substitute for a function that is included the SAE J2863 standard.

Also, reference to trailer or tow vehicle systems in the present disclosure may refer to any component or combination of components that may communicate electrical signals. In some embodiments, a system may be as simple as a wire, a series of wires, a light, a series of lights, etc., or as complex as a computer control system and related components configured to perform more sophisticated operations, or anything in-between. Some systems may be referred to as corresponding to the SAE J2863 standard and others may be referred to as being outside of or in addition to the SAE J2863 standard. Systems referred to as corresponding to the SAE J2863 standard may include those systems which have electrical connectors of connector assemblies designated thereto in the SAE J2863 standard. In addition, systems referred to as being outside of or in addition to the SAE J2863 standard may include those systems that may use electrical connections and electrical signals that are not included in the SAE J2863 standard.

For example, as indicated above, the SAE J2863 standard includes seven different electrical connectors for each plug and receptacle assembly, where each of the seven electrical connectors corresponds to one of the following: (1) left turn/brake lights; (2) "–" or ground; (3) electric brakes; (4) right turn/brake lights; (5) "+" or power supply; (6) running lights; and (7) reverse lights. Therefore, reference to systems that correspond to the SAE J2863 standard may include power systems that provide power to vehicular components; braking systems that use or provide electrical power to apply brakes; lighting systems that use or provide electrical signals corresponding to lights such as brake lights, turn signals, flashing hazard lights, running lights, reverse lights, etc.; and grounding systems that provide a grounding or return function for the electrical signals and other systems. As another example, some systems such as back-up cameras, sonar systems, tire pressure monitoring systems, weight monitoring systems, alarm systems, etc., may require the use of one or more electrical connectors different from the seven electrical connectors included in the SAE J2863 standard. Therefore, these systems may be referred to as being outside of or in addition to the SAE J2863 standard.

In addition, some systems referred to as corresponding to the SAE J2863 standard may be electrically connected to one or more of the seven electrical connectors designated according to the SAE J2863 standard. Additionally or alternatively, some systems referred to as being outside of or in addition to the SAE J2863 standard may also be electrically connected to one or more of the seven electrical connectors designated according to the SAE J2863 standard, but may also require the use of one or more other electrical connectors and corresponding electrical signals.

Moreover, reference to a plug connector corresponding to a receptacle connector or vice versa may indicate that the plug connector and the corresponding receptacle connector are configured to be electrically connected to each other when the plug assembly of which the plug connector is included is inserted into the receptacle assembly of which the receptacle connector is included. Further, reference to a component (e.g., a plug connector, a receptacle connector, a wire, etc.) corresponding to a system may indicate that the component is configured to provide electrical connections that may be used by the corresponding system.

Figure 1B:
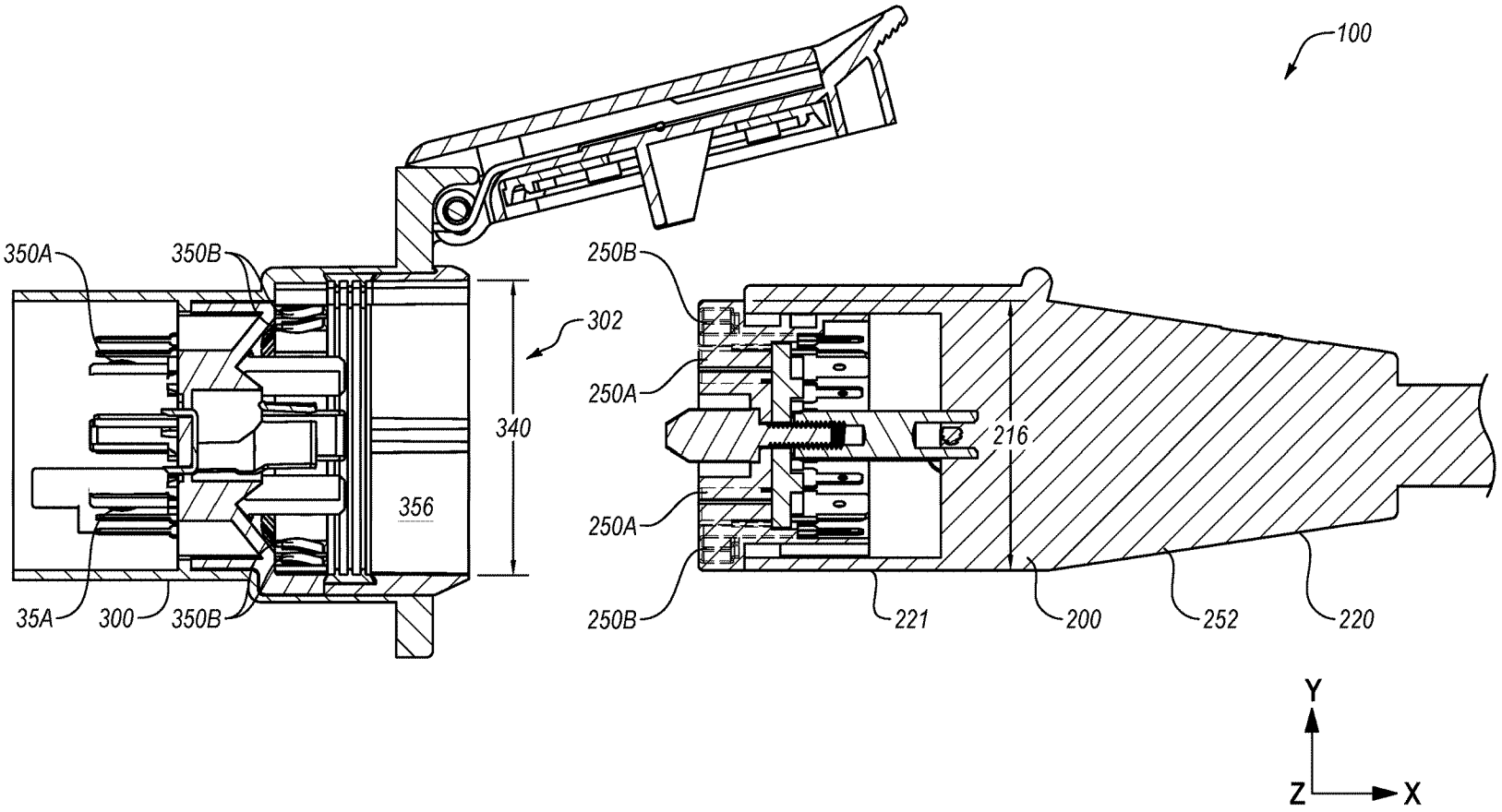
FIG. 1B illustrates another view of the connector assembly of FIG. 1A.

FIGS. 1A and 1B illustrate an example vehicle-trailer wiring connector assembly (connector assembly) 100 according to some embodiments described in the present disclosure. The connector assembly 100 may include a plug assembly 200 and a receptacle assembly 300. FIG. 1A depicts an external view of the connector assembly 100 in which plug assembly 200 and the receptacle assembly 300 are exploded from one another. FIG. 1B depicts a sectional view of the connector assembly 100 of FIG. 1A.

The connector assembly 100 is generally configured for communication of electrical signals between a tow vehicle and a trailer. For example, one or more systems of the tow vehicle may be electrically connected to receptacle connectors 350A and 350B (collectively receptacle connectors 350) of the receptacle assembly 300. One or more systems of the trailer may be electrically connected to plug connectors 250A and 250B (collectively, plug connectors 250) of the plug assembly 200. The plug assembly 200 and the receptacle assembly 300 may be configured such that when a portion of the plug assembly 200 is positioned in the receptacle assembly 300, the receptacle connectors 350 contact the plug connectors 250. Contact between the receptacle connectors 350 and the plug connectors may enable communication of electrical signals from one or more systems of the tow vehicle through one or more of the receptacle connectors 350, through corresponding plug connectors 250, and to a corresponding system of the trailer. Similarly, the contact between the receptacle connectors 350 and the plug connectors may enable communication of electrical signals from one or more systems of the trailer through one or more of the plug connectors 250, through corresponding receptacle connectors 350, and to a corresponding system of the tow vehicle. Additionally, the plug assembly 200 and the receptacle assembly 300 may be configured such that when the plug assembly 200 is withdrawn from the receptacle assembly 300 as in FIGS. 1A and 1B, the receptacle connectors 350 are electrically disconnected from the plug connectors 250.

In the embodiments of FIGS. 1A and 1B, portions of the plug assembly 200 and the receptacle assembly 300 may be constructed according to the SAE J2863 standard. Construction of portions of the receptacle assembly 300 according to the SAE J2863 standard may enable use of the receptacle assembly 300 with the plug assembly 200 of FIGS. 1A and 1B as well as with other plug assemblies that are constructed and wired according to the SAE J2863 standard. Similarly, construction of portions of the plug assembly 200 according to the SAE J2863 standard may enable use of the plug assembly 200 with the receptacle assembly 300 of FIGS. 1A and 1B as well as with other receptacle assemblies that are constructed and wired according to the SAE J2863 standard.

For instance, the receptacle assembly 300 and the plug assembly 200 include one or more physical features that are constructed according to the SAE J2863 standard. With reference to FIG. 1B, the receptacle assembly 300 may include a first cavity 302 that may further include a diameter 340. The diameter 340 of the first cavity 302 may be sized according to the SAE J2863 standard. Additionally, a cylindrical portion 221 of the plug assembly 200 may include a diameter 216 sized according to the SAE J2863 standard. The receptacle assembly 300 may accordingly be constructed to enable insertion of the plug assembly 200 of FIGS. 1A and 1B as well as any other plug assembly that may be sized according to the SAE J2863 standard. Additionally, the plug assembly 200 may be constructed to be inserted in the receptacle assembly 300 as well as any other receptacle assembly that may be sized according to the SAE J2863 standard.

Furthermore, the receptacle assembly 300 and the plug assembly 200 may include electrical features that are constructed and wired according to the SAE J2863 standard. In addition, the receptacle assembly 300 and the plug assembly 200 may include electrical features that are constructed and wired for additional systems that are not included in the SAE J2863 standard. The electrical features of the receptacle assembly 300 and the plug assembly 200 are configured to enable communication according to the SAE J2863 standard along with communication between one or more additional systems and/or communication of one or more additional signals via the connector assembly 100.

For example, one or more of the receptacle connectors 350 may correspond to the SAE J2863 standard in that the receptacle connectors 350 may be configured (e.g., sized, placed, shaped, oriented, etc.) to interface with a corresponding plug connector of a plug assembly configured according to the SAE J2863 standard.

In addition, one or more of the receptacle connectors 350 may be configured to interface with one or more corresponding additional plug connectors of another plug assembly (e.g., the plug assembly 200) in which the additional plug connectors may not be part of the SAE J2863 standard. In the embodiment of FIGS. 1A and 1B, one or more of the receptacle connectors 350 are positioned at least partially on an interior surface 356 of the first cavity 302. The receptacle connectors 350 positioned on the interior surface 356 are contactable within the first cavity 302. For instance, the receptacle connectors 350 positioned on the interior surface 356 are contactable within the first cavity 302 by one or more additional plug connectors that may not be part of the SAE J2863 standard.

The plug assembly 200 may include one or more of the plug connectors 250 that correspond to the SAE J2863 standard in that it may be configured (e.g., sized, placed, shaped, oriented, etc.) to interface with a corresponding receptacle connector of a receptacle assembly configured according to the SAE J2863 standard. In addition, one or more of the plug connectors 250 may be configured to interface with one or more corresponding additional receptacle connectors of another receptacle assembly (e.g., the receptacle assembly 300) in which the additional receptacle connectors may not be part of the SAE J2863 standard. In the embodiment of FIGS. 1A and 1B, the plug assembly 200 may include one or more of the plug connectors 250 that are aligned with an outer surface 252 of a plug housing 220 of the plug assembly 200. In the present disclosure, "aligned with" used to describe a relationship between two surfaces or between an object and a surface may include instances in which that at least some portion of the two surfaces or a portion of a surface of the object and the surface are substantially positioned in a common plane, a common arc, or a common radially plane. The plug connectors 250 aligned with the outer surface 252 of the plug housing 220 are in addition to one or more plug connectors 250 that correspond to the SAE J2863 standard. The plug connectors 250 aligned with the outer surface 252 of the plug housing 220 are externally contactable. In the present disclosure, "externally contactable" may include instances in which at least one surface may be touched by an object without introduction of the object into a defined volume. For instance, the plug connectors 250 aligned with the outer surface 252 of the plug housing 220 are externally contactable by one or more additional receptacle connectors that may not be part of the SAE J2863 standard.

When the plug assembly 200 is positioned in the first cavity 302, the plug connectors 250 that are aligned with the outer surface 252 may contact the receptacle connectors 350 positioned on the interior surface 356 of the first cavity 302. In addition, when the plug assembly 200 is positioned in the first cavity 302, the one or more plug connectors 250 that are configured according to the SAE J2863 standard may contact the one or more receptacle connectors 350 that correspond to the SAE J2863 standard.

When another plug assembly that is constructed and wired according to the SAE J2863 standard is positioned in the receptacle assembly 300, the receptacle connectors 350 that correspond to the SAE J2863 standard contact the plug connectors of the other plug assembly. However, the plug assembly that is constructed and wired according to the SAE J2863 standard may not include a plug connector that corresponds to the one or more of the receptacle connectors 350 positioned on the interior surface 356. Accordingly, any signals that may be communicated along the one or more receptacle connectors 350 positioned on the interior surface 356 may not be communicated to the plug assembly that is constructed and wired according to the SAE J2863 standard.

Similarly, when the plug assembly 200 is positioned in another receptacle assembly that is constructed and wired according to the SAE J2863 standard, the plug connectors 250 that correspond to the SAE J2863 standard contact the receptacle connectors of the receptacle assembly. However, the receptacle assembly that is constructed and wired according to the SAE J2863 standard may not include a receptacle connector that corresponds to the one or more of the plug connectors 250 aligned with the outer surface 252 of the plug housing 220. Accordingly, any signals that may be communicated along the one or more plug connectors 250 aligned with the outer surface 252 may not be communicated to the receptacle assembly that is constructed and wired according to the SAE J2863 standard.

In the illustrated embodiments of FIGS. 1A and 1B, the plug connectors 250 of the plug assembly 200 and the receptacle connectors 350 of the receptacle assembly 300 each include nineteen electrical connectors. Seven of the nineteen electrical connectors may correspond to the SAE J2863 standard. For instance, six electrical connectors and a central electrical connector may be configured according to the SAE J2863 standard such that they may correspond to the 7 systems or functions of the SAE J2863 standard. In addition, twelve of the nineteen electrical connectors may be wired to communicate electrical signals that are outside of or in addition to the SAE J2863 standard. For example, seven of the connectors in the plug connectors 250 and the receptacle connectors 350 may be configured to provide electrical connections associated with (1) left turn/stop lights; (2) "–" or ground; (3) electric brakes; (4) right turn/stop lights; (5) "+" or power supply; (6) running lights; and (7) reverse lights. The other twelve connectors may be configured to provide electrical connections that may relate to an accessory or system that is outside of or in addition to the SAE J2863 standard.

In some embodiments, the receptacle connectors 350 and/or the plug connectors 250 may include fewer than nineteen electrical connectors or more than nineteen electrical connectors. For example, the receptacle connectors 350 and/or the plug connectors 250 may each include between eight and eighteen connectors. In these embodiments, seven of the electrical connectors may correspond to the SAE J2863 standard and one or more electrical connectors may be outside of or in addition to the SAE J2863 standard.

In other embodiments that include more than nineteen connectors, seven of the connectors may correspond to the SAE J2863 standard, while six or more additional connectors may be outside of or in addition to the SAE J2863 standard. Moreover, in some embodiments, the receptacle connectors 350 and/or the plug connectors 250 may not include seven connectors that are configured according to the SAE J2863 standard. Instead, in these and other embodiments, fewer than seven of the connectors may be configured according to the SAE J2863 standard, which may enable communication of additional electrical signals associated with systems that are outside of or in addition to the SAE J2863 standard.

Figure 2A:
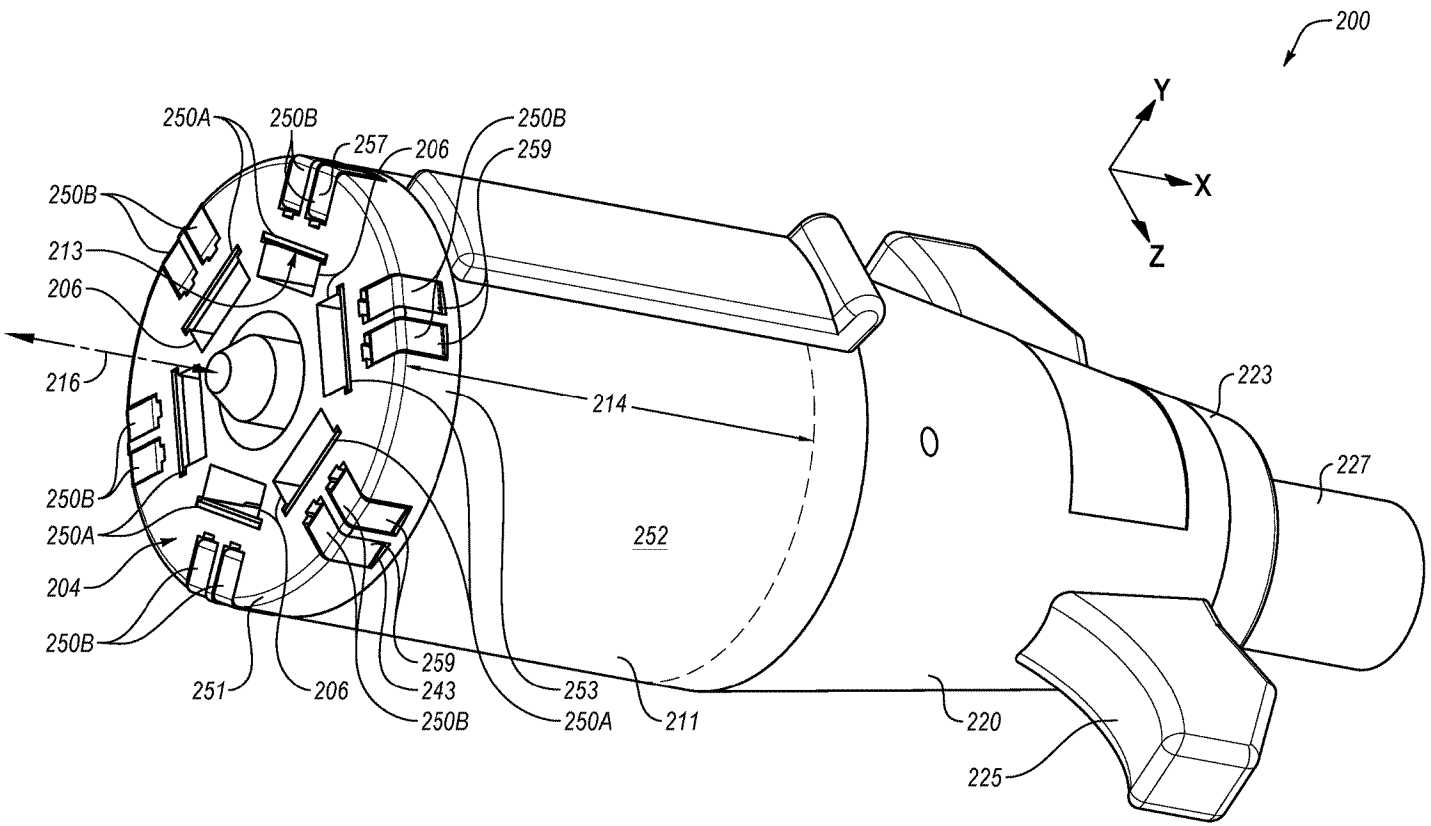
FIG. 2A illustrates an example plug assembly that may be implemented in the connector assembly of FIGS. 1A and 1B.
Figure 2B:
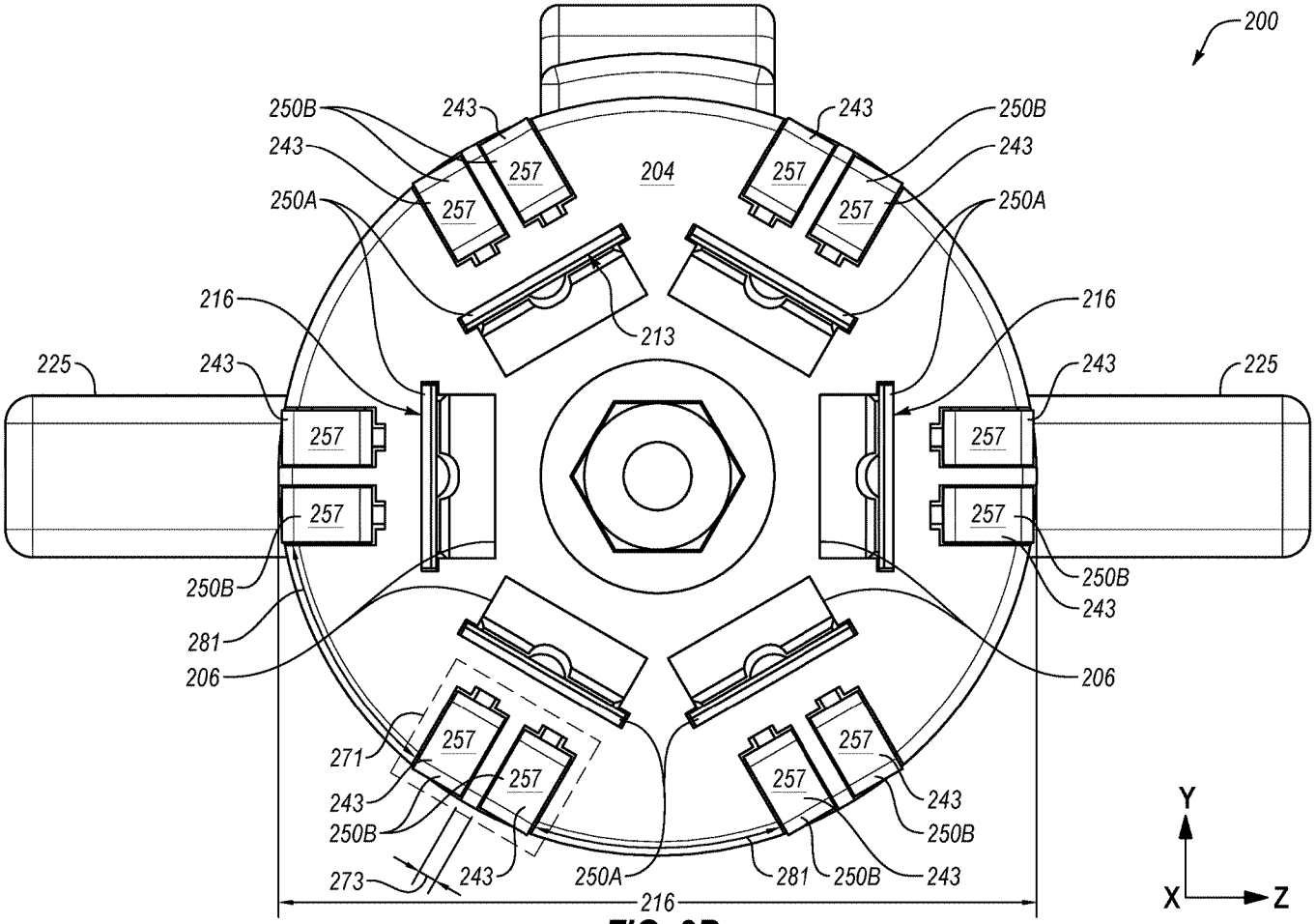
FIG. 2B illustrates another view of the plug assembly of FIG. 2A.
Figure 2C:
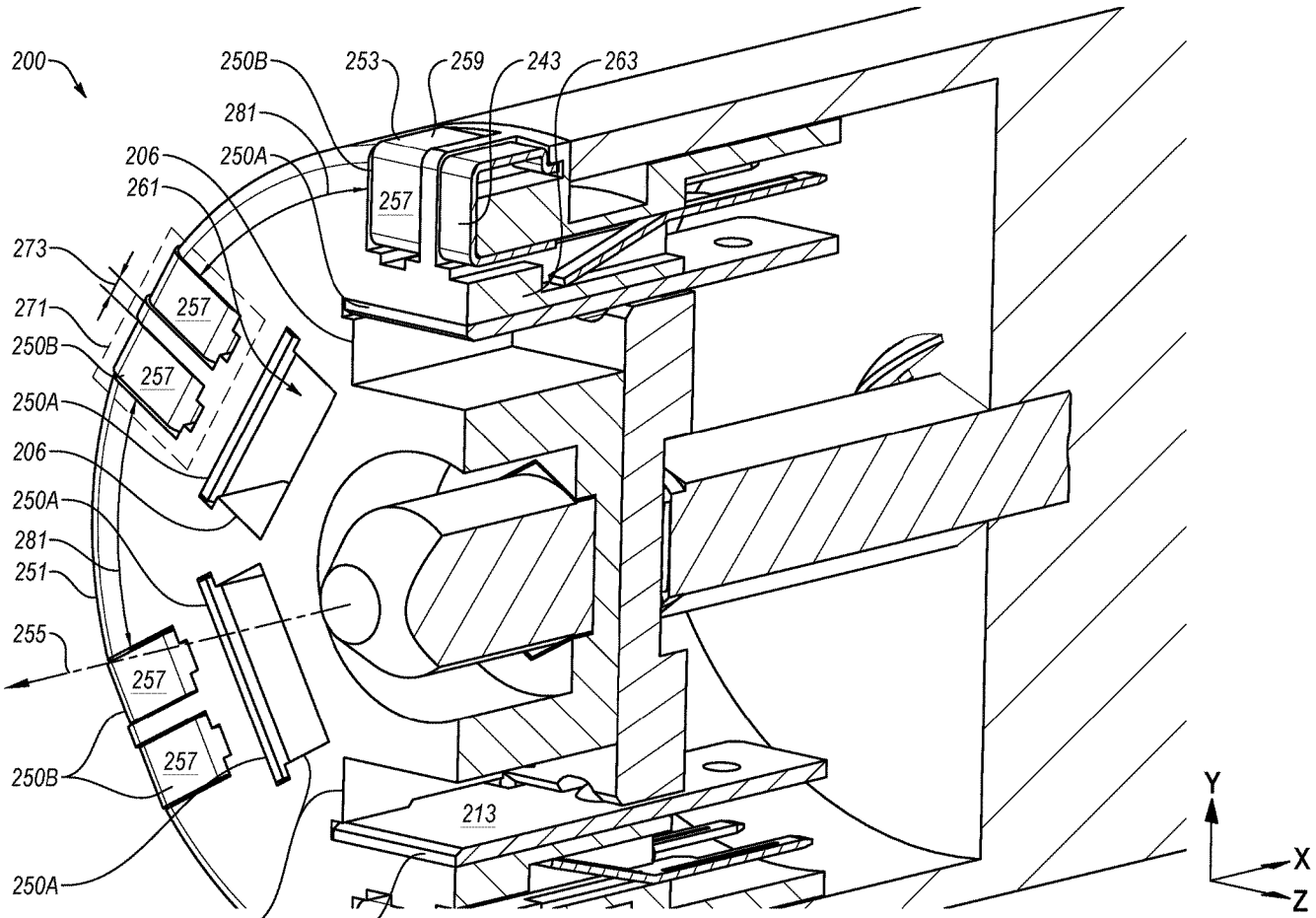
FIG. 2C illustrates another view of the plug assembly of FIG. 2A.

FIGS. 2A-2C illustrate an example embodiment of the plug assembly 200 of FIGS. 1A and 1B. FIG. 2A depicts a perspective view of the plug assembly 200. FIG. 2B depicts a front view of the plug assembly 200. FIG. 2C depicts a sectional view of a portion of the plug assembly 200.

With reference to FIG. 2A, the plug assembly 200 may include the plug housing 220, which is referenced above. The plug housing 220 includes an outer casing or housing in which the plug connectors 250 are retained or on which the plug connectors 250 are integrated or positioned. The plug housing 220 includes the cylindrical portion 221. The cylindrical portion 221 may extend from a connecting face 204 to some distance 214 from the connecting face 204. The distance 214 may correspond to a depth of a first cavity of a receptacle assembly.

The cylindrical portion 221 includes the diameter 216 (FIG. 2B). The diameter 216 may correspond or substantially correspond to a diameter of the first cavity of the receptacle assembly. For instance, the diameter 216 may be sized in accordance with SAE J2863 standard. The cylindrical portion 221 may accordingly be sized to be received in receptacle assemblies that are configured according to the SAE J2863 standard such as the receptacle assembly 300 described elsewhere in the present disclosure. In some embodiments, the diameter 216 may be about four centimeters (cm).

The plug housing 220 may include a tapered portion 223 and one or more grips 225 in some embodiments. The tapered portion 223 transitions from the cylindrical portion 221 to a cable receiving portion that may include a cable 227 coupled thereto. The grips 225 are attached to the tapered portion 223. The grips 225 may help a user remove the plug assembly 200 from a receptacle assembly. For example, the user may impose on the grips 225 a force in substantially the x-direction, which may result in movement of the plug assembly 200 in the x-direction and out of a receptacle assembly. In some embodiments, the plug housing 220 may include more than two or fewer than two grips 225. Additionally or alternatively, the grips 225 may be attached to the plug housing 220 at another location.

With reference to FIGS. 2A-2C, the plug assembly 200 may include one or more connector cavities 206 that are defined in the connecting face 204 of the plug housing 220. The connector cavities 206 extend from the connecting face 204 in the x-direction. Thus, the connector cavities 206 extend from the connecting face 204 into the plug housing 220 toward the cable 227. The connector cavities 206 do not extend through the plug housing 220 thus the connector cavities 206 are open at the connecting face 204 and do not include another opening.

In this and other embodiments, the plug assembly 200 includes six connector cavities 206. Additionally, the connector cavities 206 of the plug assembly 200 may be configured according to the SAE J2863 standard. For instance, the connector cavities 206 may be sized in compliance with the SAE J2863 standard and/or may be positioned in a hexagonal arrangement in compliance with the SAE J2863 standard. In other embodiments, the plug assembly 200 may include more than or less than six connector cavities 206. These embodiments may include a different number if connector cavities that are constructed in compliance with the SAE J2863 standard.

The plug housing 220 may be configured to retain the plug connectors 250. In some embodiments, the plug connectors 250 may be constructed of a metal such as copper, steel, zinc, or combinations thereof, or another electrically conductive material. In some embodiments, the plug housing 220 may be constructed of a plastic in which the plug connectors 250 are molded. In these and other embodiments, the plug connectors 250 may be fixed to the plug housing 220. For example, the plug connectors 250 may be soldered or epoxied to the plug housing 220.

As discussed above, one or more of the plug connectors 250 of the plug assembly 200 may be configured in compliance with the SAE J2863 standard. For example, inner plug connectors 250A may be configured in compliance with the SAE J2863 standard. In some embodiments, a subset of the inner plug connectors 250A may be configured in compliance with the SAE J2863 standard. In addition, one or more the plug connectors 250 may be configured outside of or in addition to the SAE J2863 standard. For example, outer plug connectors 250B may be configured in addition to or outside of the SAE J2863 standard. In some embodiments, a subset of the outer plug connectors 250B may not be configured in compliance with the SAE J2863 standard.

In the embodiment of FIGS. 2A-2C, one of the inner plug connectors 250A are disposed and positioned, at least partially, in each of the connector cavities 206. In the embodiment of FIGS. 2A-2C, the inner plug connectors 250A are radially displaced from a central axis 255 of the plug assembly 200. For example, a void of the connector cavity 206 is positioned between the inner plug connectors 250A and the central axis 255. When the plug assembly 200 is positioned in a receptacle assembly (e.g., the receptacle assembly 300), the inner plug connectors 250A disposed and positioned in the connector cavities 206 may connect to a receptacle connector of the receptacle assembly that is wired and constructed according to the SAE J2863 standard. For instance, the receptacle connector may be introduced into the void of the connector cavity 206 such that the receptacle connector contacts one of the inner plug connectors 250A.

The inner plug connectors 250A may include a contact surface 213, only one of which is labelled in FIGS. 2A-2C. The contact surface 213 of each of the inner plug connectors 250A may be contactable within the connector cavity 206. For example, a receptacle connector positioned in one of the connector cavities 206 may contact the contact surface 213 of the inner plug connectors 250A.

The outer plug connectors 250B of the plug assembly 200 may be disposed and positioned elsewhere with respect to the plug housing 220. For example, the outer plug connectors 250B of FIGS. 2A-2C may be positioned around a circumference of the connecting face 204.

The outer plug connectors 250B may include a contact surface 243, only one of which is labelled in FIGS. 2A and 2C, individually labelled in FIG. 2B. The contact surface 243 may include an external surface of the outer plug connectors 250B. The contact surface 243 or a portion thereof may be substantially aligned with the outer surface 252 of the plug housing 220. Accordingly, the contact surface 243 of the outer plug connectors 250B may be externally contactable.

In the embodiment of FIGS. 2A-2C, the outer plug connectors 250B or at least the contact surface 243 thereof are disposed and positioned on a circumferential edge 251 of the plug housing between the connecting face 204 and a circumferential surface 253. As best shown in FIG. 2B, a first portion 257 of the contact surface 243 of the outer plug connectors 250B may be substantially aligned with the connecting face 204. As best shown in FIG. 2A, a second portion 259 of the contact surface 243 may be substantially aligned with the circumferential surface 253 of the plug housing 220.

The first portion 257 of the contact surface 243 may be substantially perpendicular to a contact surface 213 of at least one of the inner plug connectors 250A. The second portion 259 of the contact surface 243 may be substantially parallel to the contact surface 213 of at least one of the inner plug connectors 250A. Additionally, in some embodiments, the first portion 257 and/or the second portion 259 may be oriented at another angle relative to the contact surface 213 of the inner plug connector 250A depending on the configuration of the inner plug connectors 250A and the outer plug connectors 250B. For example, the first portion 257 of the contact surface 243 may protrude from the circumferential surface 253. Accordingly, the first portion 257 of the contact surface 243 may not be substantially perpendicular to the contact surface 213.

With reference to FIGS. 2B-2C, the outer plug connectors 250B may be separated into outer plug connector pairs 271, only one of which is labelled in FIGS. 2B and 2C. The outer plug connectors 250B in the outer plug connector pair 271 may be circumferentially separated by a first distance 273. The outer plug connectors 250B may be electrically isolated from one another and/or from the inner plug connectors 250A. Each of the outer plug connectors 250B in the outer plug connector pair 271 may be circumferentially separated from outer plug connectors 250B in another of the outer plug connector pairs 271 by a second distance 281. The first distance 273 is greater than the second distance 281.

In some embodiments, the outer plug connectors 250B may not be separated into the outer plug connector pairs 271. In these and other embodiments, the first distances 273 may be less than or equal to the second distance 281.

In addition, the outer plug connectors 250B in the outer plug connector pair 271 may be positioned and/or oriented with respect to a particular inner plug connector 250A of the inner plug connectors 250A. The outer plug connectors 250B in the outer plug connector pair 271 may be radially separated from the particular inner plug connectors 250A.

Figure 2D:
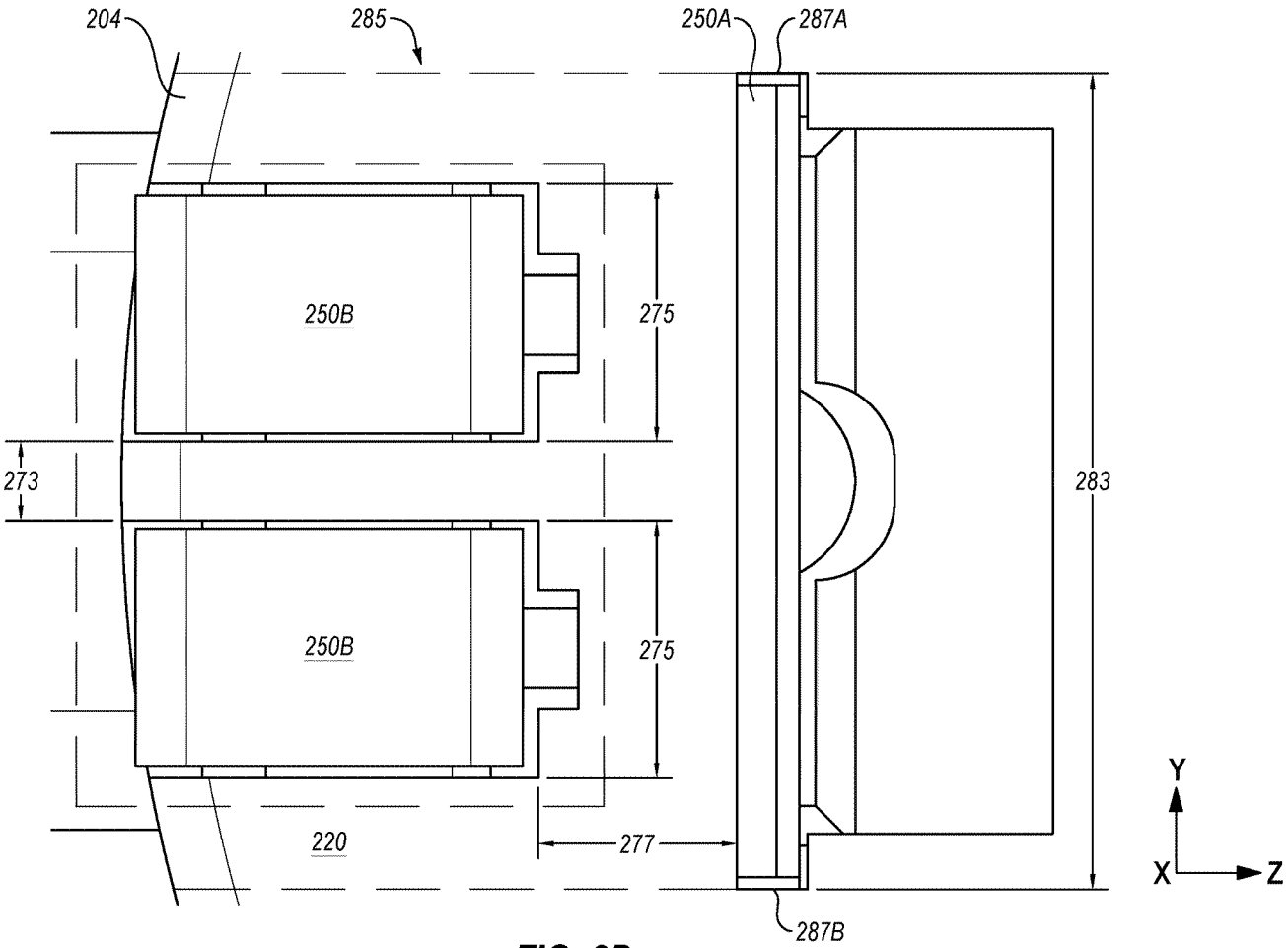
FIG. 2D illustrates a detailed view of outer plug connectors in an outer plug connector pair.

FIG. 2D depicts a detailed view of the outer plug connectors 250B in the outer plug connector pair 271 and particular inner plug connectors 250A. The outer plug connectors 250B may be radially separated a particular distance 277 from the particular inner plug connector 250A by material of the plug housing 220. Additionally, the outer plug connectors 250B in the outer plug connector pair 271 may be positioned within a circumferential portion 285 of the connecting face 204 occupied by the inner plug connectors 250A. The circumferential portion 285 may correspond to a portion of the connecting face 204 that extends radially (in the z-direction of FIG. 2D) from ends 287A and 287B of the particular inner plug connector 250A. For example, the outer plug connectors 250B of the outer plug connector pair 271 may each include a connector width 275. A sum of the connector widths 275 and the first distance 273 may be less than the length 283 of the particular inner plug connector 250A.

In the embodiment of FIGS. 2A-2C, the plug assembly 200 includes twelve of the outer plug connectors 250B that are angularly spaced around the circumference of the connecting face 204. For example, one of the outer plug connector pairs 271 may be positioned about every sixty degrees around the circumference of the connecting face 204. In this arrangement, one of the outer plug connector pairs 271 may be radially displaced from one of the inner plug connectors 250A. Accordingly, one of the inner plug connectors 250A may be positioned between each of the outer plug connector pairs 271 and the central axis 255 in the illustrated example.

In other embodiments, the outer plug connectors 250B may be configured and/or arranged differently. In some embodiments, one or more of the outer plug connectors 250B may only include the first portion 257 or the second portion 259. For example, one or more of the outer plug connectors 250B may only include the first portion 257 of the contact surface 243 and may omit the second portion 259 of the contact surface 243. Additionally or alternatively, one or more of the outer plug connectors 250B may only include the second portion 259 of the contact surface 243 and may omit the first portion 257 of the contact surface 243. In addition, in some embodiments, the contact surface 243 may not be positioned at the circumferential edge 251. Instead, the outer plug connectors 250B may be positioned within the connecting face 204 or along the cylindrical portion 221. Furthermore, some embodiments may include more than twelve outer plug connectors 250B or fewer than twelve outer plug connectors 250B. The outer plug connectors 250B may be spaced at some periodic angular interval around the circumference of the connecting face 204 or may be spaced at some other interval.

The outer plug connectors 250B may be positioned relative to the inner plug connectors 250A such that the outer plug connectors 250B are electrically insulated from the inner plug connectors 250A and from one another. For example, with reference to FIG. 2C, material 263 of the plug housing 220 may be positioned between the outer plug connectors 250B and between the inner plug connectors 250A and the outer plug connectors 250B. The material 263 of the plug housing 220 may retain the outer plug connectors 250B relative to the inner plug connectors 250A such that a separation may be maintained therebetween, which may result in electrical insulation.

Figure 3A:
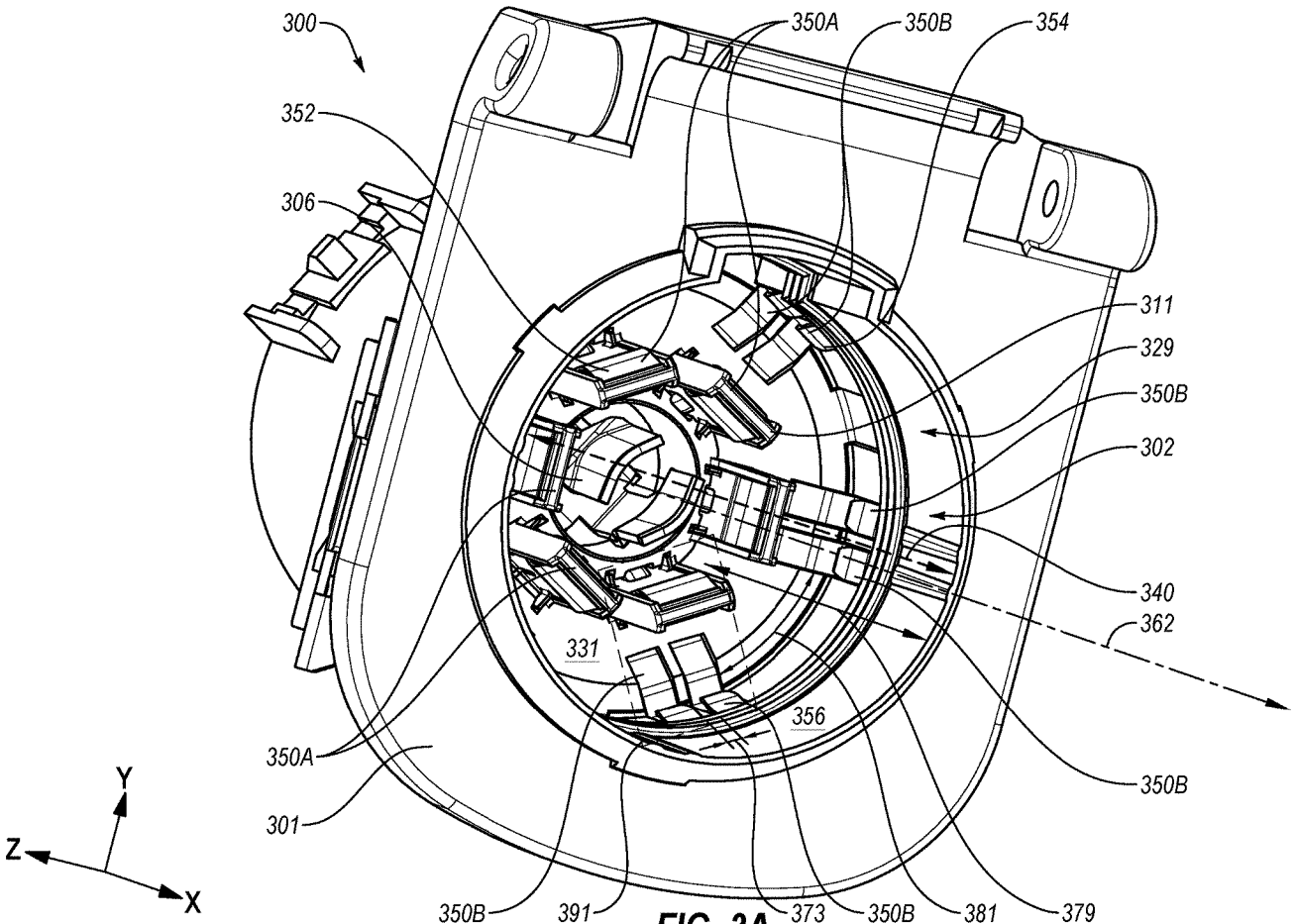
FIG. 3A illustrates an example receptacle assembly that may be implemented in the connector assembly of FIGS. 1A and 1B.
Figure 3B:
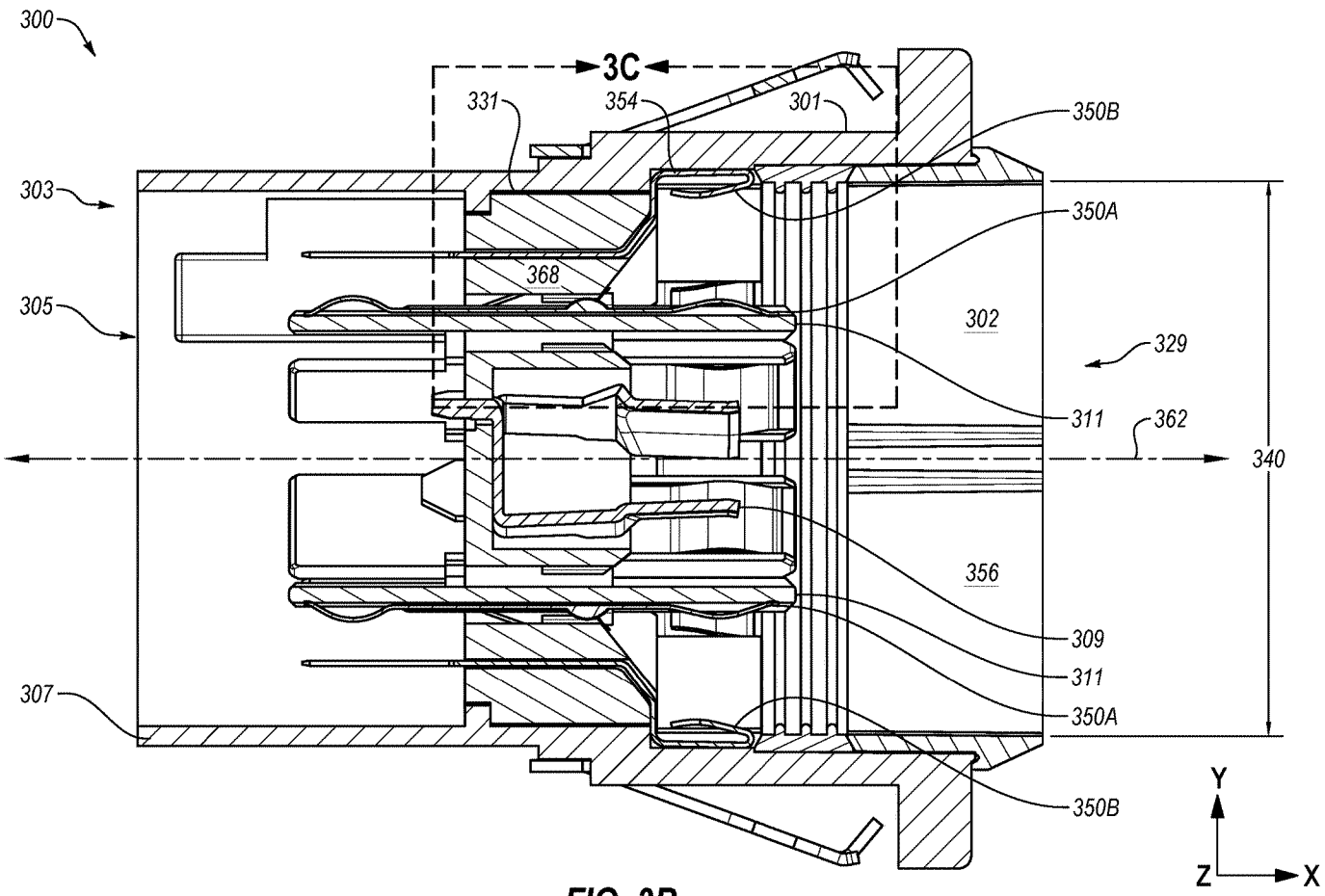
FIG. 3B illustrates another view of the receptacle assembly of FIG. 3A.
Figure 3C:
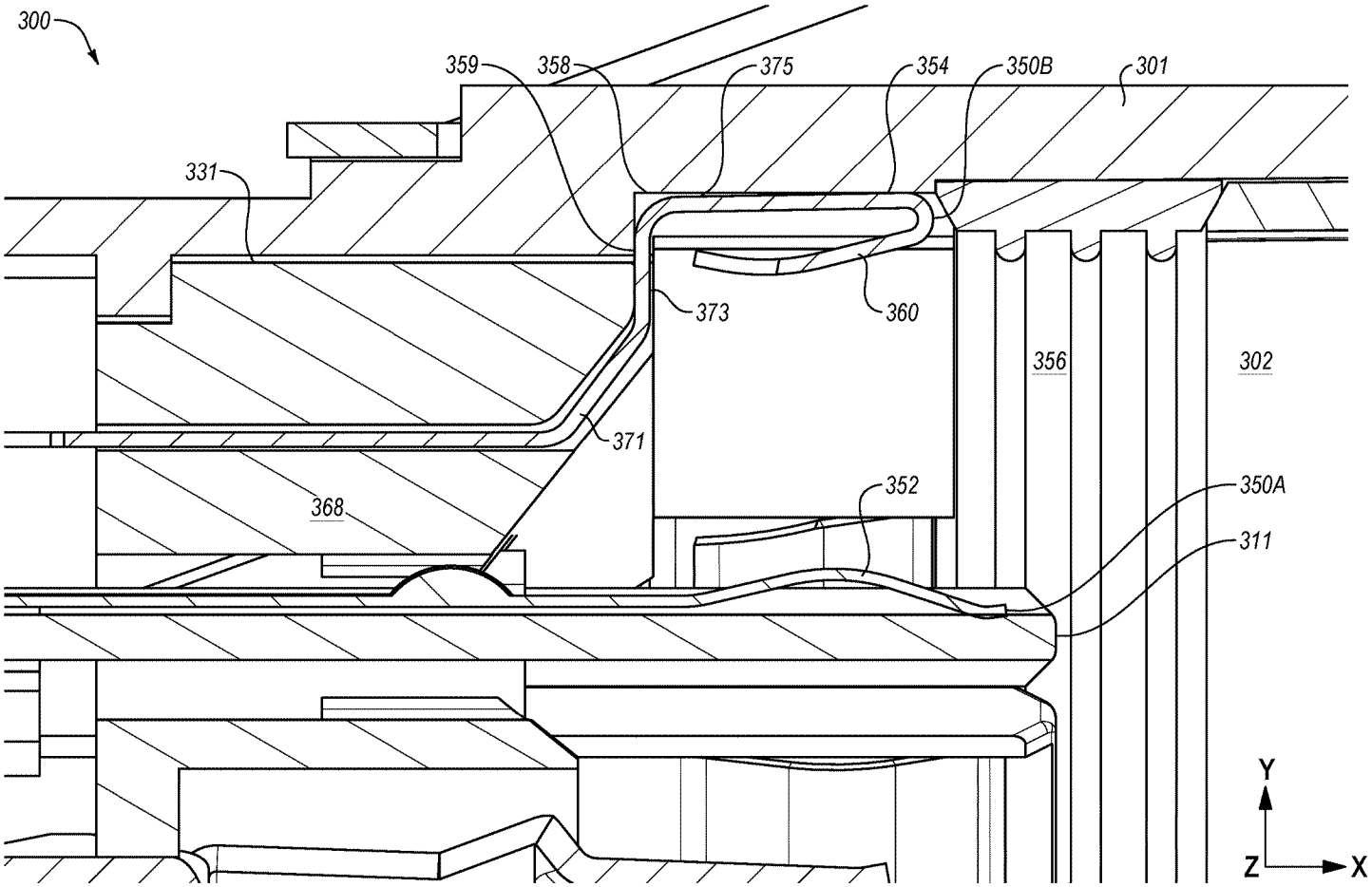
FIG. 3C illustrates another view of the receptacle assembly of FIG. 3A.

FIGS. 3A-3C illustrate an example embodiment of the receptacle assembly 300 that may be implemented in the connector assembly 100 of FIGS. 1A and 1B, according to one or more embodiments of the present disclosure. FIG. 3A depicts a perspective view of the receptacle assembly 300. FIG. 3B depicts a sectional view of the receptacle assembly 300. FIG. 3C depicts a sectional view of a portion of the receptacle assembly 300.

In FIGS. 1A and 1B, the receptacle assembly 300 may include a receptacle door. In FIGS. 3A-3C, a receptacle door is omitted from a receptacle housing 301.

The receptacle assembly 300 may include a receptacle housing 301. The receptacle housing 301 may be generally configured to retain the receptacle connectors 350 and to receive a plug assembly such as the plug assembly 200 of FIGS. 1A-2C and/or other plug assemblies configured according to the SAE J2863 standard. With reference to FIG. 3B, the receptacle housing 301 may include a central structure 331. The central structure 331 separates a second cavity 303 from the first cavity 302. The second cavity 303 may extend from the central structure 331 towards a rear opening 305 defined at a second end 307 of the receptacle housing 301. Portions of the receptacle connectors 350 may extend into the second cavity 303.

In some embodiments, wires from a tow vehicle system may be electrically connected to the portions of the receptacle connectors 350 in the second cavity 303. In some embodiments, a socket assembly may be configured to electrically and/or physically interface with the second cavity 303. The wires from the tow vehicle may be electrically connected to electrical connectors in the socket assembly. The socket assembly may then be physically interfaced with the second cavity 303 such that the electrical connectors in the socket assembly contact the portions of the receptacle connectors 350 that extend into the second cavity 303.

The first cavity 302 may be positioned on an opposite side of the central structure 331 from the second cavity 303. The first cavity 302 may be substantially cylindrical and may extend from the central structure 331 to a first end 333 of the receptacle housing 301. The first cavity 302 may include a housing opening 329 defined at the first end 333. The housing opening 329 and/or some portion of the first cavity 302 may include the diameter 340.

In some embodiments, the diameter 340 may be sized according to the SAE J2863 standard. Accordingly, in these and other embodiments, the first cavity 302 and the housing opening 329 may be configured to enable insertion of a plug assembly such as the plug assembly 200 of FIGS. 1A-2C and/or other plug assemblies constructed according to the SAE J2863 standard. An example of the diameter 340 (FIGS. 3A and 3B) may be between about four cm and about 4.5 cm, such as 4.25 cm, for example.

Referring to FIGS. 3A-3C, one or more the receptacle connectors 350 may be configured in compliance with the SAE J2863 standard. For example, in the embodiment of FIGS. 3A-3C, inner receptacle connectors 350A of the receptacle assembly 300 may be configured in compliance with the SAE J2863 standard. In some embodiments, a subset of the inner receptacle connectors 350A may be configured in compliance with the SAE J2863 standard and another subset of the inner receptacle connectors 350A may be configured outside of or in addition to the SAE J2863. In addition, one or more the receptacle connectors 350 may be configured outside of or in addition to the SAE J2863 standard. For example, in the embodiment of FIGS. 3A-3C, outer receptacle connectors 350B may be configured outside of or in addition to the SAE J2863. In some embodiments, a subset of the outer receptacle connectors 350B may be configured outside of or in addition to the SAE J2863 and another subset of the outer receptacle connectors 350B may be configured in compliance with the SAE J2863.

A portion 352 of the inner receptacle connectors 350A and a portion 354 of the outer receptacle connectors 350B may extend from the central structure 331 into the first cavity 302. The portion 352 of the inner receptacle connectors 350A and portions 352 and portion 354 of the outer receptacle connectors 350B that extend into the first cavity 302 may be contactable within the first cavity 302. For example, a plug assembly such as the plug assembly 200 of FIGS. 2A-2C may include an electrical connector that is externally contactable, such as one of the outer plug connectors 250B. When the plug assembly is positioned in the first cavity 302, the electrical connector that is externally contactable may contact the portion 354 of the outer receptacle connectors 350B.

Additionally, the portion 354 of the inner receptacle connectors 350A that extends into the first cavity 302 may be arranged such that plug connectors (e.g., one of the inner plug connectors 250A) or some portion thereof each contact one of the portions 354 of the inner receptacle connector 350A when a plug assembly is received or positioned in the first cavity 302. Moreover, in some embodiments, the inner receptacle connectors 350A may be configured to be inserted into one of the six connector cavities 206 of the plug assembly 200 of FIGS. 2A-2C or a connector cavity of a plug assembly positioned in the first cavity 302.

In FIGS. 3A-3C, the inner receptacle connectors 350A may be positioned against a tab 311. The tab 311 may at least partially retain the inner receptacle connectors 350A in the receptacle housing 301. The tab 311 may enable inclusion of one or more additional connectors (not shown) in the receptacle assembly 300. Some additional details of the additional connector(s) are provided elsewhere in the present disclosure. In some embodiments, the receptacle assembly 300 may omit the tab 311. In these and other embodiments, the inner receptacle connectors 350A may be shaped according to the J2863 standard and/or may be retained in the receptacle housing 301 by the central structure 331. For example, the central structure 331 may define an opening in which each of the inner receptacle connectors 350A are positioned.

In addition, the receptacle assembly 300 may include a central receptacle connector 309 (FIGS. 3A and 3B). The central receptacle connector 309 may be aligned substantially parallel to a central axis 362. The central receptacle connector 309 may be configured to comply with the SAE J2863 standard. In the SAE J2863, the central receptacle connector 309 may be configured to communicate electrical signals associated with the reverse lights.

The outer receptacle connectors 350B may include a portion 354 that may be disposed and positioned at least partially on an interior surface 356 of the first cavity 302. The interior surface 356 of the first cavity 302 may generally include an interior circumferential surface 358 (FIG. 3C) of the receptacle housing 301, an interior radial surface 359 (FIG. 3C) of the receptacle housing 301, and a surface of the central structure 331 that makes up a boundary of the first cavity 302, which is referred to as an interior surface 356 of the central structure 331. The interior surface 356 of the central structure 331 and the interior radial surface 359 may be substantially parallel to the plane of the housing opening 329.

The portions 354 may be disposed and positioned at one or more parts of the interior surface 356. For example, in the receptacle assembly 300 of FIGS. 3A-3C, a first section 371 (FIG. 3C) of the portion 354 of the outer receptacle connectors 350B may be disposed and positioned at the interior surface 356 of the central structure 331. A second section 373 (FIG. 3C) of the portion 354 of the outer receptacle connectors 350B may be disposed and positioned on the interior radial surface 359. A third section 375 (FIG. 3C) of the portion 354 of the outer receptacle connectors 350B may be disposed and positioned on the interior circumferential surface 358. The third section 375 of the portion 354 of the outer receptacle connectors 350B may be disposed at the interior circumferential surface 358 of the first cavity 302 immediately adjacent to the interior radial surface 359 and adjacent to the central structure 331. The outer receptacle connectors 350B may include an angled tab 360 (FIG. 3C). The angled tab 360 may extend from the interior circumferential surface 358 towards the central axis 362 of the receptacle housing 301.

With reference to FIG. 3A, the outer receptacle connectors 350B may be separated into outer receptacle connector pairs 391, only one of which is labelled in FIG. 3A. The outer receptacle connectors 350B in the outer receptacle connector pair 391 may be circumferentially separated by a first distance 393. The outer receptacle connectors 350B may be electrically isolated from one another and/or from the inner receptacle connectors 350A. Each of the outer receptacle connectors 350B in the outer receptacle connector pair 391 may be circumferentially separated from the outer receptacle connectors 350B in another of the outer receptacle connector pairs 391 by a second distance 381. The first distance 393 is greater than the second distance 381.

In some embodiments, the outer receptacle connectors 350B may not be separated into the outer receptacle connector pairs 391. In these and other embodiments, the first distance 393 may be less than or equal to the second distance 381. In addition, the outer receptacle connectors 350B in the outer receptacle connector pair 391 may be positioned and/or oriented with respect to a particular inner receptacle connector 350A of the inner receptacle connectors 350A. The outer receptacle connectors 350B in the outer receptacle connector pair 391 may be radially separated from the particular inner receptacle connectors 350A.

Figure 3D:
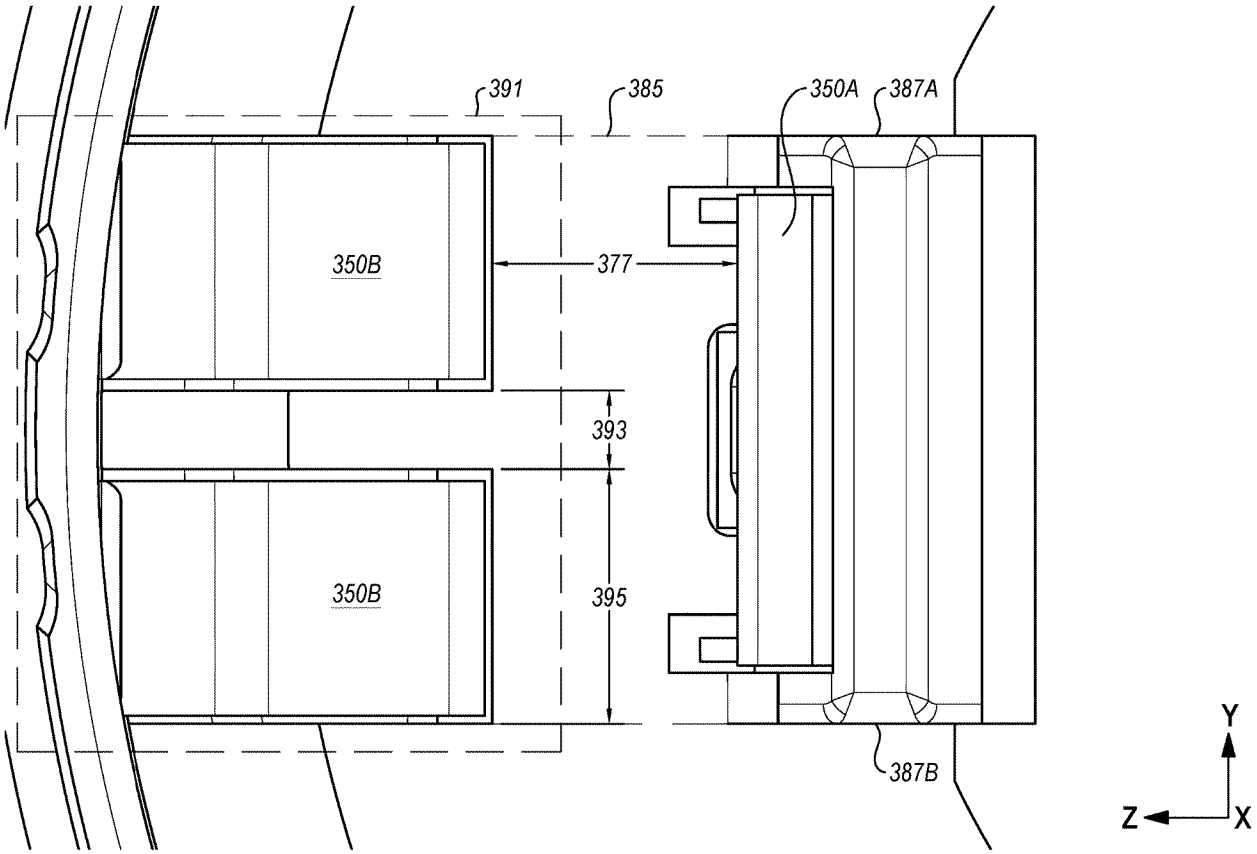
FIG. 3D illustrates a detailed view of outer receptacle connectors in an outer receptacle connector pair.

FIG. 3D depicts a detailed view of the outer receptacle connectors 350B in the outer receptacle connector pair 391 and particular inner receptacle connectors 350A. The outer receptacle connectors 350B may be radially separated a particular distance 377 from the particular inner receptacle connector 350A by material of the receptacle housing 301. Additionally, the outer receptacle connectors 350B in the outer receptacle connector pair 391 may be positioned within a circumferential portion 385 of the interior surface 356 of the first cavity 302 occupied by the particular inner receptacle connector 350A. The circumferential portion 385 may correspond to a portion of the interior surface 356 of the first cavity 302 that extends radially (in the z-direction of FIG. 3D) from ends 387A and 387B of the tab 311. For example, the outer receptacle connectors 350B of the outer receptacle connector pair 391 may each include a connector width 395. A sum of the connector widths 395 and the first distance 393 may be less than the length 383 of the tab 311.

With combined reference to FIGS. 2A-3C, the portion 354 may be contactable within the first cavity 302. For example, when the plug assembly 200 is positioned in the first cavity 302, one of the outer plug connectors 250B of the plug assembly 200 may contact the portion 354 of the outer receptacle connectors 350B. In particular, the first portion 257 of the contact surface 243 may contact the second section 373 of the portion 354 of the outer receptacle connectors 350B. Additionally, the second portion 259 of the contact surface 243 may contact the angled tab 360.

To enable contact between the outer plug connectors 250B and the outer receptacle connectors 350B, the distance 214 may be substantially similar to a depth 379 (FIG. 3A) of the first cavity 302. Accordingly, the cylindrical portion 221 of the plug assembly 200 may be configured to be positioned in the first cavity 302 with contact between the outer plug connectors 250B and the outer receptacle connectors 350B or some portion thereof.

The outer receptacle connectors 350B may take alternative configurations. The outer receptacle connectors 350B may include some subset of the first section 371, the second section 373, the third section 375, and the angled tab 360. For example, in some embodiments, the outer receptacle connectors 350B may include the first section 371, the second section 373, and the third section 375 and omit the angled tab 360. In these and other embodiments, the second portion 259 of the contact surface 243 of the plug assembly 200 may contact the second portion 259 instead of the angled tab 360. Additionally, in some embodiments, the outer receptacle connectors 350B may only include the first section 371 and the second section 373. These and other embodiments may be suitable for engagement with embodiments of the plug assembly 200 that omit the second portion 259. Additionally still, in some embodiments, the outer receptacle connectors 350B may omit the second section 373 or otherwise insulate the second section 373. These and other embodiments may be suitable for engagement with embodiments of the plug assembly 200 that omit the first portion 257. In some embodiments, the outer receptacle connectors 350B may omit all but the first section 371 which may be positioned anywhere on the interior surface of the central structure 331. These and other embodiments may be suitable for engagement with embodiments of the plug assembly 200 in which the first portion 257 is disposed at some intermediate position on the contact surface 243. In some embodiments, the outer receptacle connectors 350B may include the third section 375 that extends some length along the interior surface 356 of the first cavity 302. The third section 375 may also take multiple forms on the interior surface 356 and may terminate at any length in the first cavity 302.

In the embodiment of FIGS. 3A-3C, the receptacle assembly 300 may include twelve of the outer receptacle connectors 350B that are angularly spaced around the circumference of the first cavity 302. For example, one of the outer receptacle connectors 350B may be positioned about every sixty degrees around the circumference of the first cavity 302. In this and other arrangements, one of the outer receptacle connectors 350B may be radially displaced from one of the inner receptacle connectors 350A. Accordingly, one of the inner receptacle connectors 350A may be positioned between the outer receptacle connectors 350B and the central axis 362.

In other embodiments, the outer receptacle connectors 350B may be configured and/or arranged differently. For example, some embodiments of the receptacle assembly 300 may include more than six outer receptacle connectors 350B or fewer than six outer receptacle connectors 350B. The outer receptacle connectors 350B may be spaced at some periodic angular interval around the circumference of first cavity 302 or may be spaced at some other interval.

In the embodiments of FIGS. 3A-3C, the outer receptacle connectors 350B are positioned relative to the inner receptacle connectors 350A such that the outer receptacle connectors 350B are electrically insulated from the inner receptacle connectors 350A and from one another. For example, referring to FIG. 3C, material 368 of the central structure 331 may be positioned between the inner receptacle connectors 350A and the outer receptacle connectors 350B and between the outer receptacle connectors 350B.

In some embodiments, the receptacle connectors 350 may be constructed of a metal such as copper, steel, zinc, combinations thereof, or another electrically conductive material. In some embodiments, the receptacle housing 301 may be constructed of a plastic in which the receptacle connectors 350 are positioned. In some embodiments, the receptacle housing 301 may be constructed of a metal or another material. In these and other embodiments, the receptacle connectors 350 may be fixed to the receptacle housing 301. For example, the receptacle connectors 350 may be soldered or epoxied to the receptacle housing 301.

FIGS. 1A-3C depict a connector assembly 100 that includes one or more features that correspond to the SAE J2863 standard. Some embodiments of the connector assembly 100 may include one or more features that correspond to another connector assembly standard. For instance, in some embodiments, one or more receptacle connectors 350 and/or plug connectors 250 may correspond to the SAE J560b standard. In these and other embodiments, the receptacle connectors 350 may include one or more SAE J560b connectors that are constructed and wired according to the SAE J560b standard as well as one or more connectors that are outside of or in addition to the SAE J560b standard.

Figure 4:
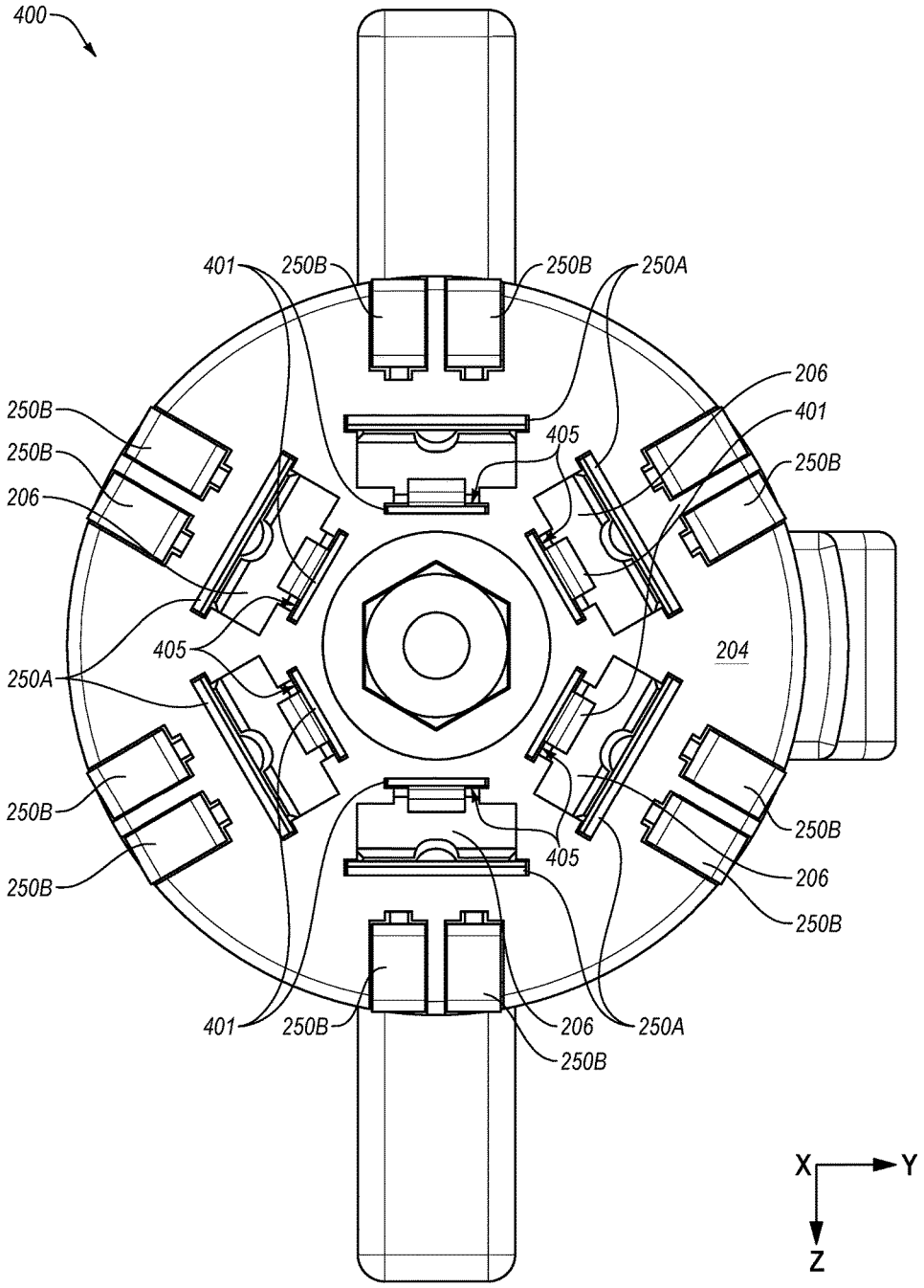
FIG. 4 illustrates another example plug assembly.

FIG. 4 illustrates another example plug assembly 400 in accordance with at least one embodiment of the present disclosure. FIG. 4 is a front view of the plug assembly 400.

The plug assembly 400 may be substantially similar to the plug assembly 200 described elsewhere in the present disclosure except the plug assembly 400 may include additional plug connectors 401. For example, the plug assembly 400 of FIG. 4 may include the inner plug connectors 250A, the outer plug connectors 250B and the additional plug connectors 401. The additional plug connectors 401 may be outside of or in addition to the J2863 standard. Each of the additional plug connectors 401 may be disposed and positioned with respect to a separate one of the six connector cavities 206 such that a contact surface 405 of each of the additional plug connectors 401 may be contactable within the corresponding connector cavity 206. Additionally, each of the additional plug connectors 401 may be disposed and positioned with respect to the six connector cavities 206 such that the additional plug connectors 401 may be displaced relative to the inner plug connector 250A also positioned in the connector cavity 206. The additional plug connectors 401 may be displaced relative to the inner plug connector 250A in a manner in which the additional plug connectors 401 may be electrically insulated from the inner plug connector 250A.

In some embodiments, the additional plug connectors 401 may be configured as described in U.S. patent application Ser. No. 15/197,337, which is incorporated herein by reference in its entirety.

Figure 5:
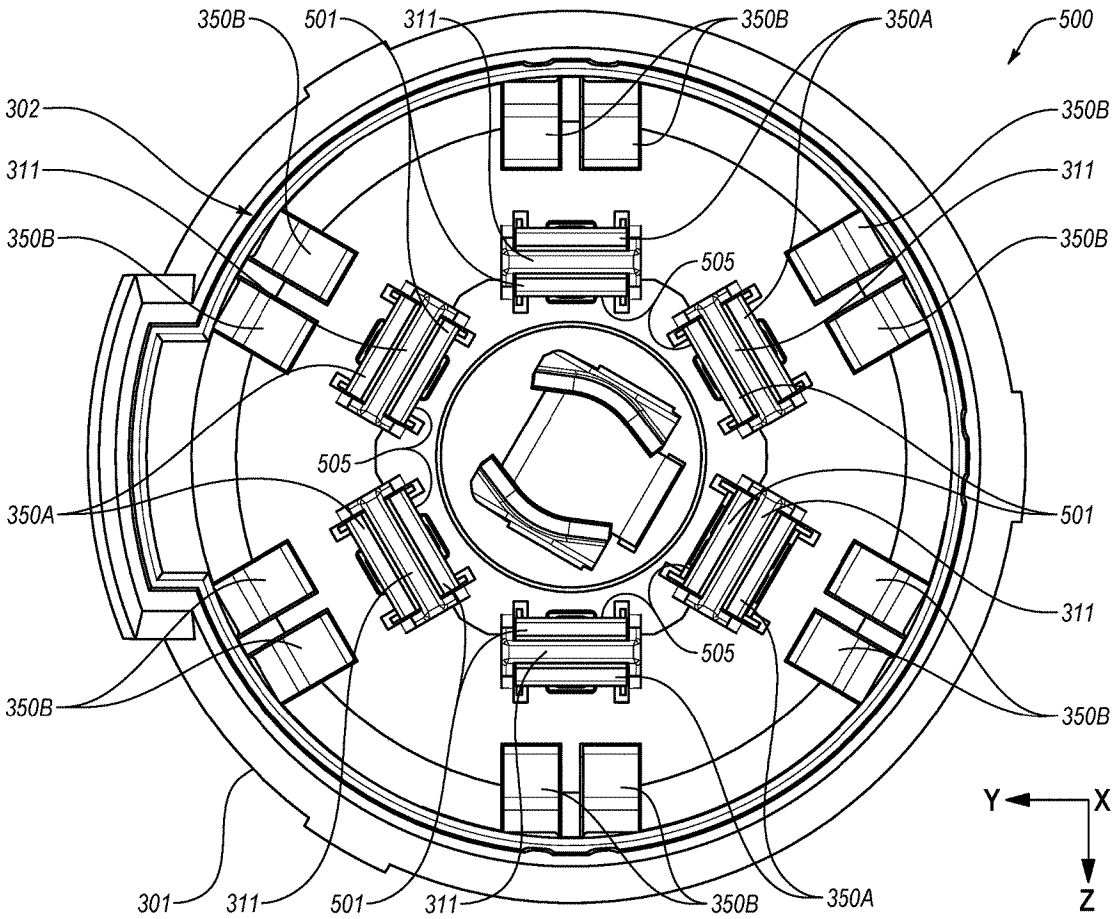
FIG. 5 illustrates another example receptacle assembly.

FIG. 5 illustrates another example receptacle assembly 500 in accordance with at least one embodiment of the present disclosure. The receptacle assembly 500 may be substantially similar to the receptacle assembly 300 described elsewhere in the present disclosure except the receptacle assembly 500 may include additional receptacle connectors 501. FIG. 5 depicts a front view of the receptacle assembly 500 with a flange portion of the receptacle housing 301 removed.

The receptacle assembly 500 of FIG. 5 may include the inner receptacle connectors 350A, the outer receptacle connectors 350B, and the additional receptacle connectors 501. The additional receptacle connectors 501 may be outside of or in addition to the J2863 standard. Each of the additional receptacle connectors 501 may be disposed and positioned with respect to one of the inner receptacle connectors 350A such that a contact surface 505 of each of the additional receptacle connectors 501 may be contactable within the first cavity 302. Additionally, each of the additional receptacle connectors 501 may be displaced relative to one of the inner receptacle connectors 350A in a manner in which the additional receptacle connectors 501 may be electrically insulated from the inner receptacle connectors 350A. For example, one of the tabs 311 may be positioned between each pair of one of the additional receptacle connectors 501 and one of the inner receptacle connectors 350A. One of the inner receptacle connectors 350A, one of the additional receptacle connectors 501, and one of the tabs 311 may be positioned in one of the connector cavities 206 of the plug assembly 200 or another plug assembly.

In some embodiments, the additional receptacle connectors 501 may be configured as described in U.S. patent application Ser. No. 15/197,328, which is incorporated herein by reference in its entirety.

Figure 6:
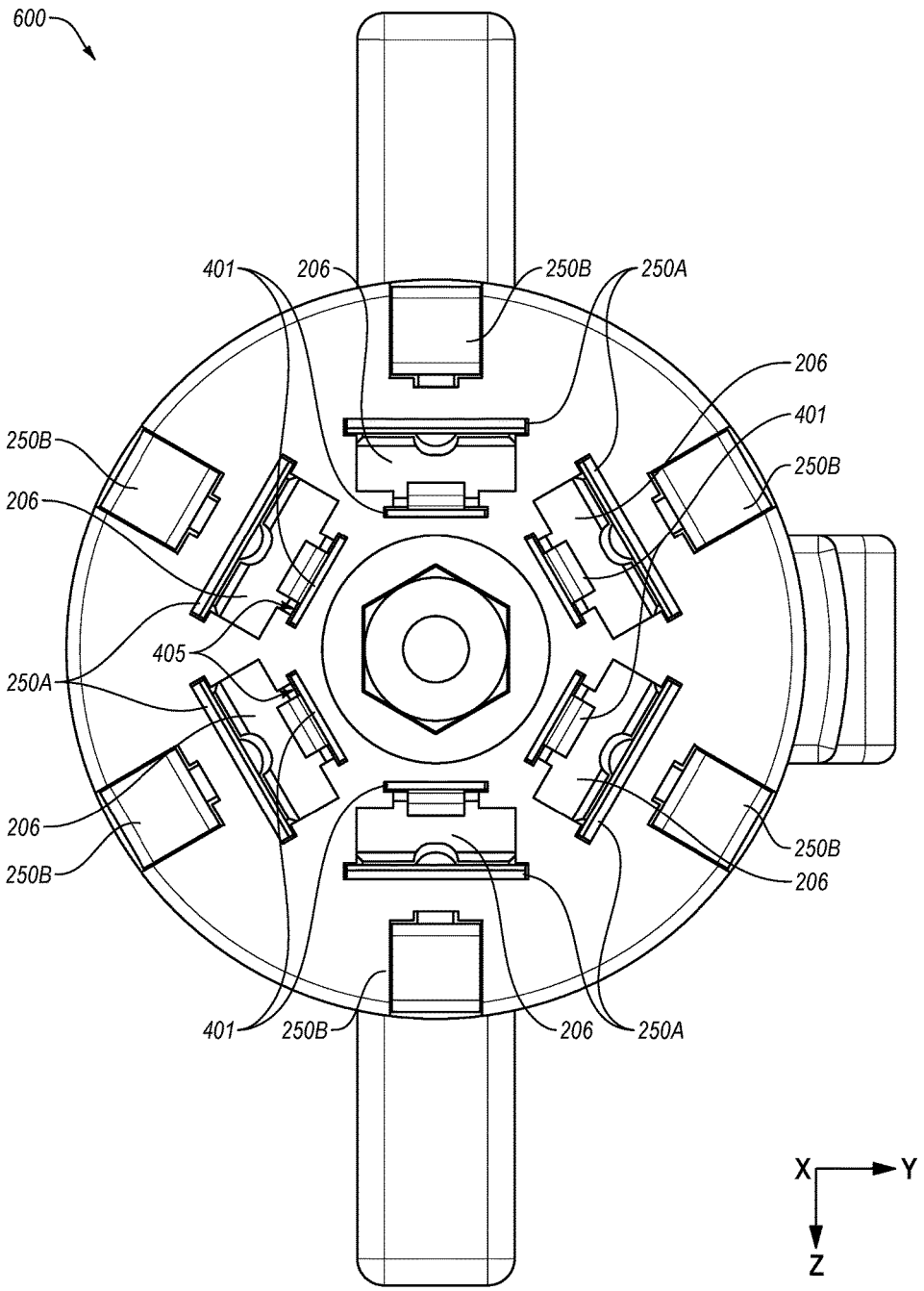
FIG. 6 illustrates another example plug assembly.

FIG. 6 illustrates another example plug assembly 600 in accordance with at least one embodiment of the present disclosure. FIG. 6 is a front view of the plug assembly 600. The plug assembly 600 of FIG. 6 may be substantially similar to the plug assembly 400 of FIG. 4 with fewer of the outer plug connectors 250B. In the embodiment of FIG. 6, one of the outer plug connectors 250B may be positioned within the circumferential portion of the connecting face 204 occupied by one the inner plug connectors 250A.

In some embodiments, the plug assembly 600 may omit the additional plug connectors 401. For example, the plug assembly 600 may include the inner plug connectors 250A and outer plug connectors 250B. Additionally or alternatively, three or more of the outer plug connectors 250B may be positioned within the circumferential portion of the connecting face 204 occupied by one the inner plug connectors 250A. Additionally still, a number of the outer plug connectors 250B positioned within the circumferential portion of the connecting face 204 occupied by one the inner plug connectors 250A may vary from one of the inner plug connectors 250A to another. For example, three of the outer plug connectors 250B may be positioned within the circumferential portion of the connecting face 204 occupied by a first of the inner plug connectors 250A and one of the outer plug connectors 250B may be positioned within the circumferential portion of the connecting face 204 occupied by a second of the inner plug connectors 250A.

Figure 7:
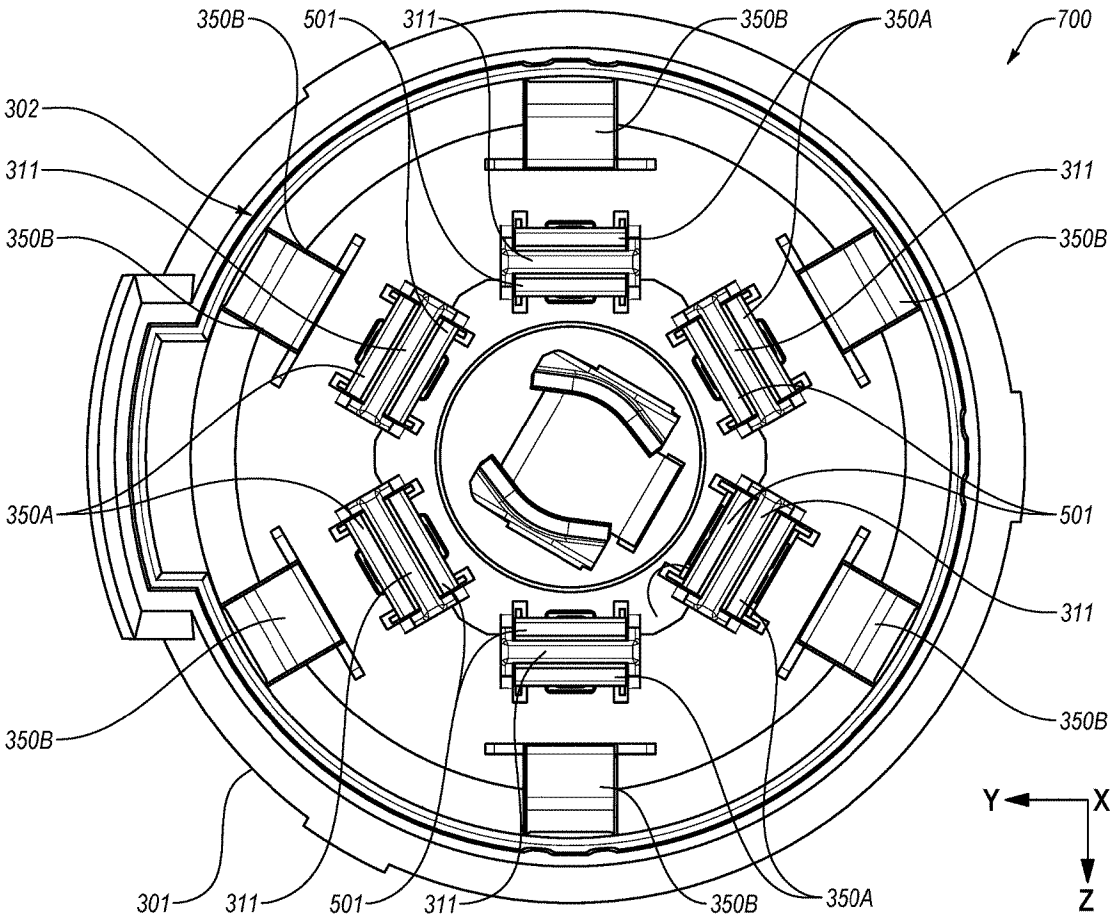
FIG. 7 illustrates another example receptacle assembly.

FIG. 7 illustrates another example receptacle assembly 700 in accordance with at least one embodiment of the present disclosure. FIG. 7 is a front view of the receptacle assembly 700. The receptacle assembly 700 may be substantially similar to the receptacle assembly 500 depicted in FIG. 5 with fewer of the outer receptacle connectors 350B. In the embodiment of FIG. 7, one of the outer receptacle connectors 350B may be positioned within the circumferential portion of the interior surface 356 of the first cavity 302 occupied by one the inner receptacle connectors 350A.

In some embodiments, the receptacle assembly 700 may omit the additional receptacle connectors 501. For example, the receptacle assembly 700 may include the inner receptacle connectors 350A and the outer receptacle connectors 350B. Additionally or alternatively, three or more of the outer receptacle connectors 350B may positioned within the circumferential portion of the interior surface 356 of the first cavity 302 occupied by one the inner receptacle connectors 350A. Additionally still, a number of the outer receptacle connectors 350B positioned within the circumferential portion of the interior surface 356 of the first cavity 302 occupied by one the inner receptacle connectors 350A may vary from one of the inner receptacle connectors 350A to another. For example, three of the outer receptacle connectors 350B may be positioned within the circumferential portion of the interior surface 356 of the first cavity 302 occupied by a first of the inner receptacle connectors 350A and one of the outer receptacle connectors 350B may be positioned within the circumferential portion of the interior surface 356 of the first cavity 302 occupied by a second of the inner receptacle connectors 350A.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one," "one or more," "at least one of the following," and "one or more of the following" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B.

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited in the present disclosure are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. A plug assembly for a vehicle-trailer wiring connector assembly, the plug assembly comprising:

a plug housing that is configured to be positioned in a receptacle assembly;

six connector cavities that are defined in the plug housing and that are radially disposed around a connecting face of the plug housing in an arrangement in compliance with the Society of Automotive Engineers ("SAE") J2863 standard;

a first electrical connector disposed and positioned with respect to a first connector cavity of the six connector cavities such that a first contact surface of the first electrical connector is contactable within the first connector cavity; and a second electrical connector disposed and positioned with respect to the plug housing such that a second contact surface of the second electrical connector is substantially aligned with an outer surface of the plug housing and externally contactable and such that the second electrical connector is positioned relative to the first electrical connector in a manner in which the second electrical connector is electrically insulated from the first electrical connector.

2. The plug assembly of claim 1, wherein at least a portion of the second electrical connector is disposed and positioned on a circumferential edge between the connecting face and a circumferential surface of the plug housing.

3. The plug assembly of claim 1, wherein:

at least a portion of the second contact surface of the second electrical connector is substantially aligned with the connecting face; and the first electrical connector and the second electrical connector are disposed such that the first contact surface and at least a portion of the second contact surface are substantially perpendicular to each other.

4. The plug assembly of claim 1, wherein:

at least a portion of the second contact surface of the second electrical connector is substantially aligned with a circumferential surface of the plug housing; and the first electrical connector and the second electrical connector are disposed such that the first contact surface and at least a portion of the second contact surface are substantially parallel to each other.

5. The plug assembly of claim 1, further comprising a third electrical connector disposed and positioned with respect to the plug housing such that:

a third contact surface of the third electrical connector is substantially aligned with the outer surface of the plug housing and externally contactable, and the third electrical connector is positioned relative to the first electrical connector and the second electrical connector in a manner in which the third electrical connector is electrically insulated from the first electrical connector and the second electrical connector.

6. The plug assembly of claim 5, wherein:

the third electrical connector and the second electrical connector are radially displaced from the first electrical connector;

the third electrical connector is circumferentially displaced from the second electrical connector; and the third electrical connector and the second electrical connector are positioned within a circumferential portion of the connecting face occupied by the first electrical connector.

7. The plug assembly of claim 1, wherein the first electrical connector and the second electrical connector are separated by material of the plug housing.

8. The plug assembly of claim 1, wherein the first electrical connector is positioned between the second electrical connector and a central axis of the plug housing.

9. The plug assembly of claim 1, wherein:

the first electrical connector is disposed and positioned with respect to the first connector cavity in compliance with the SAE J2863 standard; and the six connector cavities are sized in compliance with the SAE J2863 standard.

10. The plug assembly of claim 1, wherein:

the first electrical connector is one of six first electrical connectors;

each of the six first electrical connectors is disposed and positioned with respect to a separate one of the six connector cavities in accordance with the SAE J2863 standard;

the second electrical connector is one of a plurality of second electrical connectors that each have a second contact surface; and each of the plurality of second electrical connectors is disposed and positioned with respect to the plug housing such that the second contact surface of each of the plurality of second electrical connectors is substantially aligned with an outer surface of the plug housing and externally contactable and such that each of the plurality of second electrical connectors is positioned relative to one of the six first electrical connectors in a manner in which each of the plurality of second electrical connectors is electrically insulated from the six first electrical connectors and each other of the plurality of second electrical connectors.

11. The plug assembly of claim 10, further comprising a plurality of third electrical connectors that each have a third contact surface, wherein each of the plurality of third electrical connectors is disposed and positioned with respect to a separate one of the six connector cavities such that its corresponding third contact surface is contactable within the corresponding connector cavity and such that the corresponding third electrical connector is displaced relative to the first electrical connector that corresponds to the corresponding connector cavity in a manner in which the corresponding third electrical connector is electrically insulated from the first electrical connector that corresponds to the corresponding connector cavity.

12. A vehicle-trailer wiring connector assembly (connector assembly) comprising:

a receptacle assembly; and a plug assembly including:

a plug housing that is configured to be positioned in the receptacle assembly;

six connector cavities that are defined in the plug housing and that are radially disposed around a connecting face of the plug housing in accordance with the Society of Automotive Engineers ("SAE") J2863 standard;

a first electrical connector disposed and positioned with respect to a first connector cavity of the six connector cavities such that a first contact surface of the first electrical connector is contactable within the first connector cavity;

a second electrical connector disposed and positioned with respect to a second connector cavity of the six connector cavities such that a second contact surface of the second electrical connector is contactable within the second connector cavity;

a third electrical connector disposed and positioned with respect to a third connector cavity of the six connector cavities such that a third contact surface of the third electrical connector is contactable within the third connector cavity;

a fourth electrical connector disposed and positioned with respect to a fourth connector cavity of the six connector cavities such that a fourth contact surface of the fourth electrical connector is contactable within the fourth connector cavity;

a fifth electrical connector disposed and positioned with respect to a fifth connector cavity of the six connector cavities such that a fifth contact surface of the fifth electrical connector is contactable within the fifth connector cavity;

a sixth electrical connector disposed and positioned with respect to a sixth connector cavity of the six connector cavities such that a sixth contact surface of the sixth electrical connector is contactable within the sixth connector cavity; and a seventh electrical connector disposed and positioned with respect to the plug housing such that a seventh contact surface of the seventh electrical connector is substantially aligned with an outer surface of the plug housing and externally contactable and such that the seventh electrical connector is positioned relative to the first electrical connector in a manner in which the second electrical connector is electrically insulated from the first electrical connector.

13. The connector assembly of claim 12, wherein at least a portion of the seventh contact surface of the seventh electrical connector is substantially aligned with the connecting face of the plug housing and/or substantially aligned with a circumferential surface of the plug housing.

14. The connector assembly of claim 12, wherein the plug assembly further includes an eighth electrical connector that is disposed and positioned with respect to the plug housing such that:

an eighth contact surface of the eighth electrical connector is substantially aligned with the outer surface of the plug housing and externally contactable, and the eighth electrical connector is positioned relative to the first electrical connector and the seventh electrical connector in a manner in which the eighth electrical connector is electrically insulated from the first electrical connector and the seventh electrical connector.

15. The connector assembly of claim 14, wherein:

the eighth electrical connector and the seventh electrical connector are radially displaced from the first electrical connector;

the eighth electrical connector is circumferentially displaced from the seventh electrical connector; and the eighth electrical connector and the seventh electrical connector are positioned within a circumferential portion of the connecting face occupied by the first electrical connector.

16. The connector assembly of claim 15, wherein:

the first electrical connector is separated from the seventh electrical connector and the eighth electrical connector by material of the plug housing;

the seventh electrical connector is separated from the eighth electrical connector by material of the plug housing; and the first electrical connector is positioned between the seventh electrical connector and a central axis of the plug housing.

17. The connector assembly of claim 12, wherein the receptacle assembly includes:

a receptacle housing that includes a first cavity, the first cavity extending from a first end of the receptacle housing to a central structure of the receptacle housing;

a housing opening defined at the first end, wherein at least a portion of the first cavity and at least a portion of the housing opening is sized and shaped to enable insertion of the plug assembly;

a first receptacle connector with a first portion that extends from the central structure into the first cavity, wherein the first receptacle connector is sized such that the first receptacle connector is configured to be inserted into one of the six connector cavities of the plug assembly; and a second receptacle connector that includes a second portion that is disposed and positioned at least partially on an interior surface of the first cavity and contactable within the first cavity, wherein the second receptacle connector is electrically insulated from the first receptacle connector.

18. The connector assembly of claim 17, wherein the second portion of the second receptacle connector includes:

a first section that is disposed and positioned on a portion of the interior surface of the first cavity located at the central structure;

a second section that is disposed and positioned on a portion of an interior radial surface of the first cavity; and a third section that is disposed and positioned on an interior circumferential surface of the first cavity immediately adjacent to the interior radial surface.

19. The connector assembly of claim 18, wherein the second receptacle connector includes an angled tab that extends from the interior circumferential surface towards a central axis of the receptacle housing.

20. The connector assembly of claim 17, wherein:

the receptacle assembly further includes a third receptacle connector that includes a third portion that is disposed and positioned at least partially on the interior surface of the first cavity and contactable within the first cavity; and the third receptacle connector is electrically insulated from the first receptacle connector and the second receptacle connector.

21. The connector assembly of claim 20, wherein a third receptacle connector is disposed and positioned with respect to the plug housing such that:

the third receptacle connector and the second receptacle connector are radially displaced from the first receptacle connector;

the third receptacle connector is circumferentially displaced from the second receptacle connector; and the third receptacle connector and the second receptacle connector are positioned within a circumferential portion of the interior surface of the first cavity occupied by the first receptacle connector.

22. The connector assembly of claim 12, wherein:

the first electrical connector is disposed and positioned with respect to the first connector cavity in compliance with the SAE J2863 standard;

the second electrical connector is disposed and positioned with respect to the second connector cavity in compliance with the SAE J2863 standard;

the third electrical connector is disposed and positioned with respect to the third connector cavity in compliance with the SAE J2863 standard;

the fourth electrical connector is disposed and positioned with respect to the fourth connector cavity in compliance with the SAE J2863 standard;

the fifth electrical connector is disposed and positioned with respect to the fifth connector cavity in compliance with the SAE J2863 standard;

the sixth electrical connector is disposed and positioned with respect to the sixth connector cavity in compliance with the SAE J2863 standard;

the six connector cavities are sized in compliance with the SAE J2863 standard; and the seventh electrical connector is configured to communicate a signal outside of the SAE J2863 standard.

23. The connector assembly of claim 12, further comprising an eighth electrical connector disposed and positioned with respect to the first connector cavity such that an eighth contact surface of the eighth electrical connector is contactable within the first connector cavity and such that the eighth electrical connector is displaced relative to the first electrical connector in a manner in which the eighth electrical connector is electrically insulated from the first electrical connector.

* * * * *